US006900689B2

(12) United States Patent
Kimura

(10) Patent No.: US 6,900,689 B2
(45) Date of Patent: May 31, 2005

(54) CMOS REFERENCE VOLTAGE CIRCUIT

(75) Inventor: Katsuji Kimura, Tokyo (JP)

(73) Assignee: NEC Electronics Corporation (JP)

( * ) Notice: Subject to any disclaimer, the term of this patent is extended or adjusted under 35 U.S.C. 154(b) by 0 days.

(21) Appl. No.: 10/091,776

(22) Filed: Mar. 5, 2002

(65) Prior Publication Data

US 2002/0163379 A1 Nov. 7, 2002

(30) Foreign Application Priority Data

Mar. 8, 2001 (JP) ..... 2001-064287

(51) Int. Cl.[7] ..... G05F 1/10; G05F 1/575
(52) U.S. Cl. ..... 327/542; 327/543; 323/316
(58) Field of Search ..... 327/513, 538–543; 323/313–316

(56) References Cited

U.S. PATENT DOCUMENTS 4,857,823 A * 8/1989 Bitting ..... 323/314
5,867,054 A * 2/1999 Kotowski ..... 327/513
6,091,287 A * 7/2000 Salter et al. ..... 327/543
6,150,872 A * 11/2000 McNeill et al. ..... 327/539

FOREIGN PATENT DOCUMENTS

JP A 8-314561 11/1996 ..... G05F/3/30

* cited by examiner

*Primary Examiner*—Timothy P. Callahan
*Assistant Examiner*—Terry L. Englund
(74) *Attorney, Agent, or Firm*—Hayes Soloway P.C.

(57) ABSTRACT

A CMOS reference voltage circuit, preferably formed on a semiconductor integrated circuit, and outputting a reference voltage having a temperature-independent characteristic, comprises first and second diode-connected transistors (or diodes), respectively grounded and driven with two constant currents bearing a constant current ratio to each other, and a unit for amplifying a differential voltage of output voltages from the first and second transistors by a preset factor and for summing the amplified differential voltage to an output voltage of the first or second transistor. The amplifying and summing unit is formed by two OTAs 11, 12 and a current mirror circuit 13. The first OTA 11 is fed with the differential voltage and the second OTA 12 has a reverse phase input terminal fed with an output voltage from the first or second transistor and a forward phase input terminal connected to its output terminal and driven with a current proportional to an output current of the first OTA 11, with an output terminal voltage of the second OTA 12 being used as an output voltage.

20 Claims, 10 Drawing Sheets

CM OS REFERENCE VOLTAGE CIRCUIT

FIELD OF THE INVENTION

This invention relates to a reference voltage circuit. More particularly, it relates to a CMOS reference voltage circuit which is preferably formed on a semiconductor integrated circuit and outputs a temperature-independent reference voltage.

BACKGROUND OF THE INVENTION

Up to now, there have been a large number of publications regarding a reference voltage circuit which demonstrates a temperature independent characteristic by canceling a temperature dependent characteristic and which outputs a reference voltage of the order of 1.2 V.

First, the operation of a conventional reference voltage circuit is explained.

FIG. 10 shows an example of a conventional CMOS (Complementary MOS) reference voltage circuit. The reference voltage is obtained by inserting a resistor in a current loop of a reference current circuit which is termed a PTAT (Proportional to Absolute Temperature) current source circuit since in general the reference current circuit outputs the current proportional to temperature.

In FIG. 10, it is assumed that a transistor Q1 is a unit transistor and that the emitter area of a transistor Q2 is K1 times that of the unit transistor(K1>1).

If the base width modulation is neglected, the relationship between the collector current IC to the base-to-emitter voltage VBE of a transistor is given by:

$$IC=K\cdot IS\exp(VBE/VT) \tag{1}$$

where IS is the saturation current of a unit transistor and VT is the thermal voltage, which is given by:

$$VT=kT/q$$

where q is the magnitude of the unit electron charge, k is Boltzmann's constant, T is absolute temperature in kelvins, and K is the emitter area ratio referenced to the unit transistor.

Assuming that the DC current amplification factor of a transistor is sufficiently close to 1, and the base current is neglected, we shall find the following relationships:

$$VBE1=VT\ln\{IC1/IS\} \tag{2}$$

$$VBE2=VT\ln(IC2/(K1\cdot IS)) \tag{3}$$

$$VBE1=VBE2+R1\cdot IC2 \tag{4}$$

where ln {} is a logarithmic function.

By solving the equation (2) to (4), we obtain $$VT\ln\{K1\cdot IC1/IC2\}=R1\cdot IC2 \tag{5}$$

It is noted that, since transistors Q1 and Q2 controls the common gate voltage of transistors M3 and M4 through an operational amplifier 20 so that the equation (4) will be held valid, the transistors Q1 and Q2 are self-biased, and hence the drain currents ID3 and ID4 of the transistors M3 and M4 are equal to each other and $$ID3=ID4=IC1=IC2 \tag{6}$$

From the equation (5), we shall therefore have the following equation:

$$ID3=ID4=IC1=IC2VT\ln(K1)/R1 \tag{7}$$

The drain current ID3 of the transistor M3 is converted by the resistor R2 to a voltage and becomes the reference voltage VREF. That is, the reference voltage VREF is expressed as follow.

$$VREF=VBE1+R2\cdot ID3=VBE1+R2\cdot VT\ln(K1)/R1 \tag{8}$$

In the equation (8), the base-to-emitter voltage VBE1 of the transistor Q1, which is driven by the PTAT reference current, has a negative temperature characteristic on the order of approximately −1.9 mV/° C., which is slightly less than −2 mV, while the thermal voltage VT has a positive temperature characteristic of 0.0853 mV/° C.

Accordingly, in order that the output reference voltage VREF will not exhibit a temperature dependent characteristic, the cancellation of temperature dependency of the output reference voltage VREF may be performed by a combination of a voltage exhibiting a positive temperature characteristic and a voltage exhibiting a negative temperature characteristic.

That is, the value of (R2/R1)ln(K1) is 22.3, while that of (R2/R1)VT ln(K1) is 0.57V.

If the base-to-emitter voltage VBE1 is 0.7 V, $$\{VBE1+(R2/R1)VT\ln(K1)\}=1.27\text{V}$$

SUMMARY OF THE DISCLOSURE

Up to now, in the reference voltage circuit for outputting the reference voltage not exhibiting this sort of temperature characteristic, an operational amplifier is used in a feedback circuit, and a resistor is introduced in a current loop of the PTAT current source circuit, so that a desired resistance ratio is required. The voltage drop across a resistor on the order of approximately 0.6 V is needed for one resistor. Thus, if it is desired to diminish the driving current of a transistor connected in a diode configuration, a large resistance value is required, thus increasing a chip size.

A reference voltage circuit, exemplified first and foremost by a bias voltage of the circuitry, arranged in a large number of LSIs, including digital LSIs, such as memory devices, to say nothing of an analog LSI, is routinely used. In particular, a reference voltage circuit, which outputs a voltage not exhibiting a temperature dependent characteristic, is generally termed "a band gap reference voltage circuit".

The output voltage of a band gap reference voltage circuit is close to 1.205 V, which is the band gap voltage of Silicon at 0° K.

Since the CMOS process nowadays is predominantly used, realization of a circuit with part elements that can be readily manufactured by the CMOS process has been desired. In particular, it is more desirable that a standard digital CMOS process can smoothly realize a circuit. In such case, however, a high precision resistance ratio or a high resistance leads to an increase of a chip size.

Accordingly, it is an object of the present invention to provide a reference voltage circuit for outputting a reference voltage not exhibiting a temperature characteristic, which can be implemented only using transistors without adopting a high precision resistance ratio or a high resistance to simplify the circuit structure.

A CMOS reference voltage circuit in accordance with one aspect of the present invention comprises first and second diode-connected transistors (or diodes), which are grounded, and are driven respectively by two constant currents, bearing a constant current ratio, and means for amplifying a differential voltage between output voltages of the first and second diode-connected transistors (or diodes) by a predetermined constant factor and summing the resulting amplified voltage to an output voltage of the first or second diode-connected transistor (or diode), in which said means for amplification and summation includes first and second operational transconductance amplifiers (OTAs) and a current mirror circuit, in which the first OTA is fed with the differential voltage, the second OTA has a first input terminal(−) fed with an output voltage from the first or second diode-connected transistor (or diode) and a second input terminal(+) connected to an output terminal and driven with a current proportional to the output current of said first OTA, an output terminal voltage of the second OTA being an output reference voltage.

In accordance with the present invention, the transconductance gm1 of the first OTA gm1 is equal to the transconductance gm2 of the second OTA (gm1=gm2), and the current ratio of the input current to the output current in the current mirror circuit is set to 1:K2, where K2>1, to produce a desired amplification factor.

In accordance with the present invention, the current ratio of the input current to the output current in the current mirror circuit is equal (1:1) and the transconductance gm1 of the first OTA1 and that gm2 of the second OTA 2 are set so that gm1=K2×gm2, where K2>1, to obtain a desired amplification factor.

In accordance with the present invention, the current ratio of the input current to the output current in the current mirror circuit is set to 1:K2, where K2>1, and the transconductance gm1 of the first OTA1 and that gm2 of the second OTA 2 are set so that gm1=K3×gm2, where K3>1, to obtain a desired amplification factor.

A CMOS reference voltage circuit in accordance with another aspect of the present invention, comprises first and second diode-connected transistors (or diodes), which are grounded, and are driven respectively by two constant currents, bearing a constant current ratio, and means for amplifying a differential voltage between output voltages of the first and second diode-connected transistors (or diodes) by a predetermined constant factor and summing the resulting amplified voltage to an output voltage of the first or second diode-connected transistor (or diode), in which the means for amplification and summation includes (K2+1) differential pairs, K2 being an integer not less than 1, the first differential pair being fed with the differential voltage, one of differential pair transistors of the second differential pair being fed with an output voltage of the first or second diode-connected transistor, the other of the differential pair transistors being diode-connected and being driven with the current proportional to the output current of one of the transistors of the first differential pair, output voltages of diode-connected transistors of the second to number K2 differential pairs are fed to one of the differential pair transistors of the third to the number (K2+1) differential pairs, respectively, the other transistors of the differential pair transistors being diode-connected and driven by currents proportional to the output current of the one transistor of the first differential pair, with the first to number (K2+1) differential pairs being driven with the (K2+1) constant currents bearing a certain constant current ratio relative to one another, with the differential input voltages of the second to number (K2+1) differential pairs being summed together to produce a desired amplification factor.

A CMOS reference voltage circuit in accordance with another aspect of the present invention comprises first and second diode-connected transistors (or diodes), which are respectively grounded, and are driven by two constant currents, bearing a constant current ratio, and means for amplifying a differential voltage of output currents of the first and second diode-connected transistors (or diodes) by a preset factor and summing the resulting amplified voltage to an output voltage of the first or second diode-connected transistor (or diode), in which said means for amplification and summation includes (K2+1) differential pairs, with the first differential pair being fed with the differential voltage, one of differential pair transistors of the second differential pair being fed with an output voltage of the first or second diode-connected transistor, the other of the differential transistors being diode-connected, the differential transistors of the third to number K2 differential pairs being diode-connected, the one diode-connected differential transistor of a given stage being driven by the constant current with the other diode-connected differential transistor of a preceding stage, the other diode-connected transistor being driven with the current proportional to the output current of the first differential pair, the first to number (K2+1) differential pairs being driven with (K2+1) constant currents bearing a certain constant current ratio to one another, with the differential input voltages of the second to number (K2+1) differential pairs being summed together to produce a desired amplification factor.

A CMOS reference voltage circuit in accordance with another aspect of the present invention comprises first and second diode-connected transistors (or diodes), which are grounded, and respectively driven with two constant currents, bearing a constant current ratio, and means for amplifying a differential voltage of output voltages of the first and second diode-connected transistors (or diodes) by a preset factor and summing the resulting amplified voltage to an output voltage of the first or second diode-connected transistor (or diode), in which said means for amplification and summation is made up of two differential pairs, one of the differential transistors of a second one of the differential pairs being fed with an output voltage of the first or second diode-connected transistors (or diodes), the other differential transistor being diode-connected and being driven with the current proportional to the output current of one of the transistors of the first differential pair, the first differential pair and the second differential pair being driven with two constant currents having a constant current ratio to each other, an operating input voltage range of the second differential pair being a constant number tuple of the operating input voltage range of the first differential pair to produce a desired amplification factor.

In accordance with the present invention, the first diode-connected transistor (or diode) is equal to the second diode-connected transistor (or diode), with the ratio of respective driving currents not being equal to 1.

In accordance with the present invention, the size of the first diode-connected transistor (or diode) is K1 times the size of the second diode-connected transistor (or diode), with the driving current ratio not being equal to 1.

In accordance with the present invention, the size of the first diode-connected transistor (or diode) differs from the size of the second diode-connected transistor (or diode), with the driving current ratio being equal to 1.

In accordance with the present invention, the gate W/L ratio of each transistor of the first differential pair is K2 times the gate W/L ratio of each transistor of the second differential pair, W and L being the gate width and the gate length of the transistor, respectively, the driving current of the second differential pair being K3 times the driving current of the third differential pair, the output current of the first differential pair being multiplied by K3 to drive the diode-connected transistor of the second differential pair to produce the desired amplification factor.

The present invention is constituted by a grounded diode-connected transistor, (or diode) driven at a constant current, and an operational amplifier having a voltage follower type offset, for receiving an output voltage of the diode-connected transistor (or diode).

In accordance with the present invention, the operational amplifier is driven with the constant current, each of two transistors making up an input differential pair has a gate W/L ratio of 1:K2, and the gate W/L ratio of the two transistors forming an active load operating as a load to the two transistors is K3:1, with offset values being summed together.

In accordance with the present invention, each of two transistors making up an input differential pair has a gate W/L ratio of K2:1, and the gate W/L ratio of the two transistors forming an active load operating as a load to the two transistors is 1:K3, with offset values being subtracted.

Still other objects and advantages of the present invention will become readily apparent to those skilled in this art from the following detailed description in conjunction with the accompanying drawings wherein only the preferred embodiments of the invention are shown and described, simply by way of illustration of the best mode contemplated of carrying out this invention. As will be realized, the invention is capable of other and different embodiments, and its several details are capable of modifications in various obvious respects, all without departing from the invention. Accordingly, the drawing and description are to be regarded as illustrative in nature, and not as restrictive.

PREFERRED EMBODIMENTS OF THE INVENTION

The preferred embodiments of the present invention will now be described. If two transistors, both of which have emitters grounded and are connected in diode configuration, are driven by a current mirror circuit, and the current densities of the two transistors are made different from each other to produce different base-to-emitter voltages VBEs, a differential voltage ΔVBE of the base-to-emitter voltages of the two transistors is proportional to absolute temperature, and hence a voltage proportional to the thermal voltage VT is obtained.

On the other hand, the base-to-emitter voltage VBE of a transistor has a negative temperature characteristic on the order of approximately −2 mV/° C. to −1.9 mV/° C.

In general, in a conventional reference voltage circuit, a reference voltage circuit which outputs a constant voltage not exhibiting a temperature dependent characteristic, is realized by weight-summing the voltage VTPAT proportional to absolute temperature and the voltage VIPTAT inversely proportional to absolute temperature.

This constant voltage is of a voltage value such that VPTAT+VIPTAT≈1.2V or thereabout.

In the conventional reference voltage circuit, this weight summation of the voltages VPTAT and VIPTAT is realized by a resistor inserted on a PTAT current path of VIPTAT, and is termed "ΔV multiplier".

In accordance with the present invention, the weight summation is not realized by a resistor, but by a differential pair.

Figure 1:
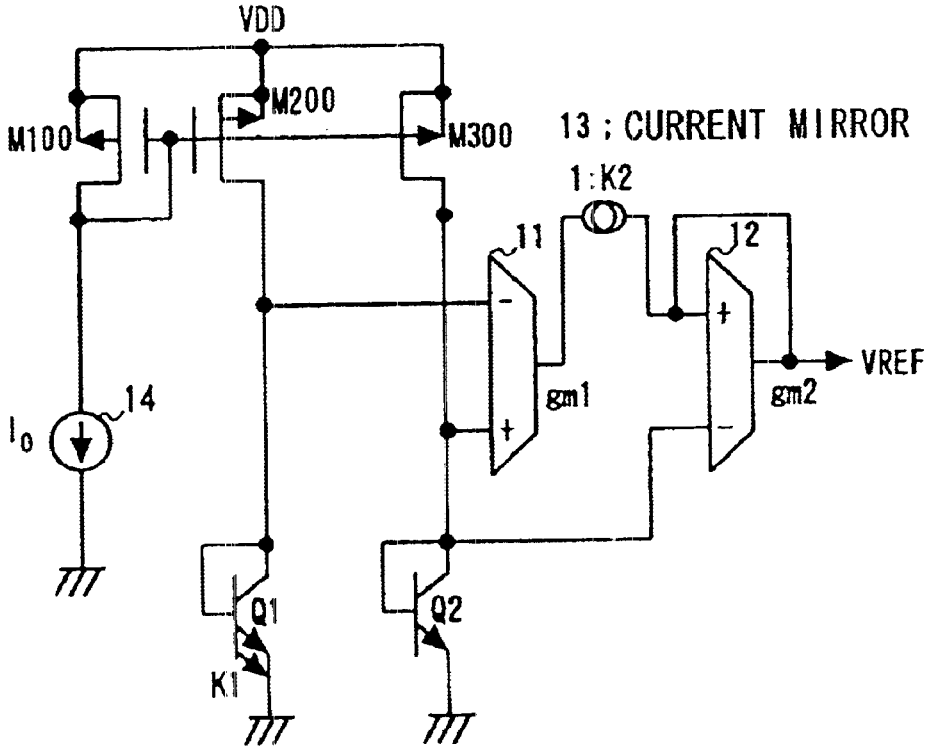
FIG. 1 shows a circuit structure of an embodiment of the present invention.

An embodiment of the present invention is shown in FIG. 1, showing two OTAs (operational transconductance amplifiers) 11 and 12, in which a differential input voltage is proportional to an output current and in which a transconductance exhibits a linear characteristic. Across these OTAs, the current (K2×gm1ΔVBE) having a predetermined constant ratio K2 to an output current (gm1ΔVBE) of the first OTA 11, which is proportional to a differential voltage VBE (=VBE2−VBE1) of the base-to-emitter voltage VBE of two bipolar transistors Q1 and Q2, is caused to flow into the second OTA 12 to produce a voltage corresponding to the differential voltage ΔVBE multiplied by a constant value, that is VPTAT (K2×gm1 ΔVBE/gm2). In the second OTA 12, the base-to-emitter voltage VBE2 of the transistor Q2 is summed to VPTAT and the resulting voltage is output to produce a desired constant voltage VREF not exhibiting a temperature dependent characteristic.

Figure 5:
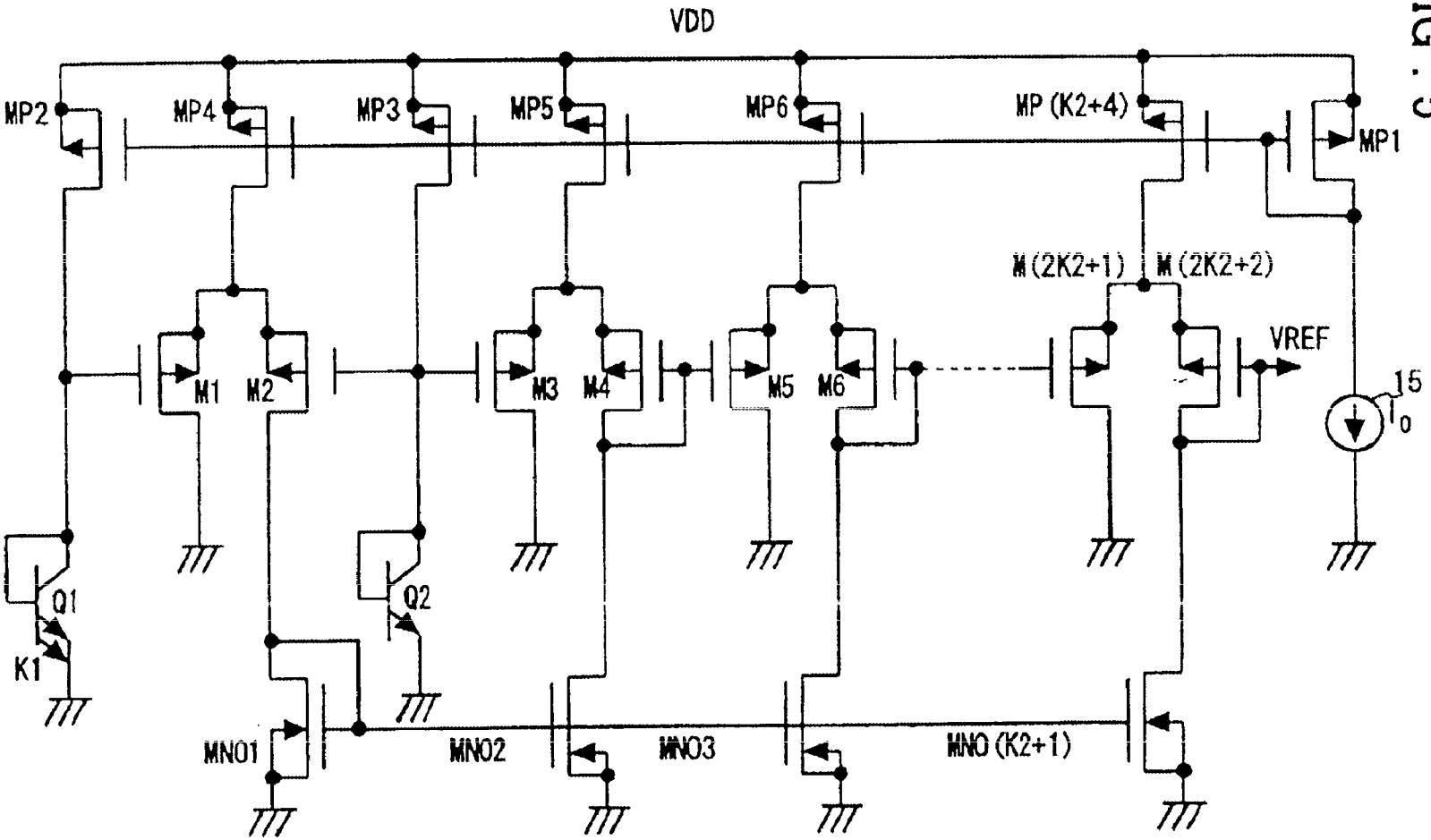
FIG. 5 shows a circuit structure of a second embodiment of the present invention.
Figure 6:
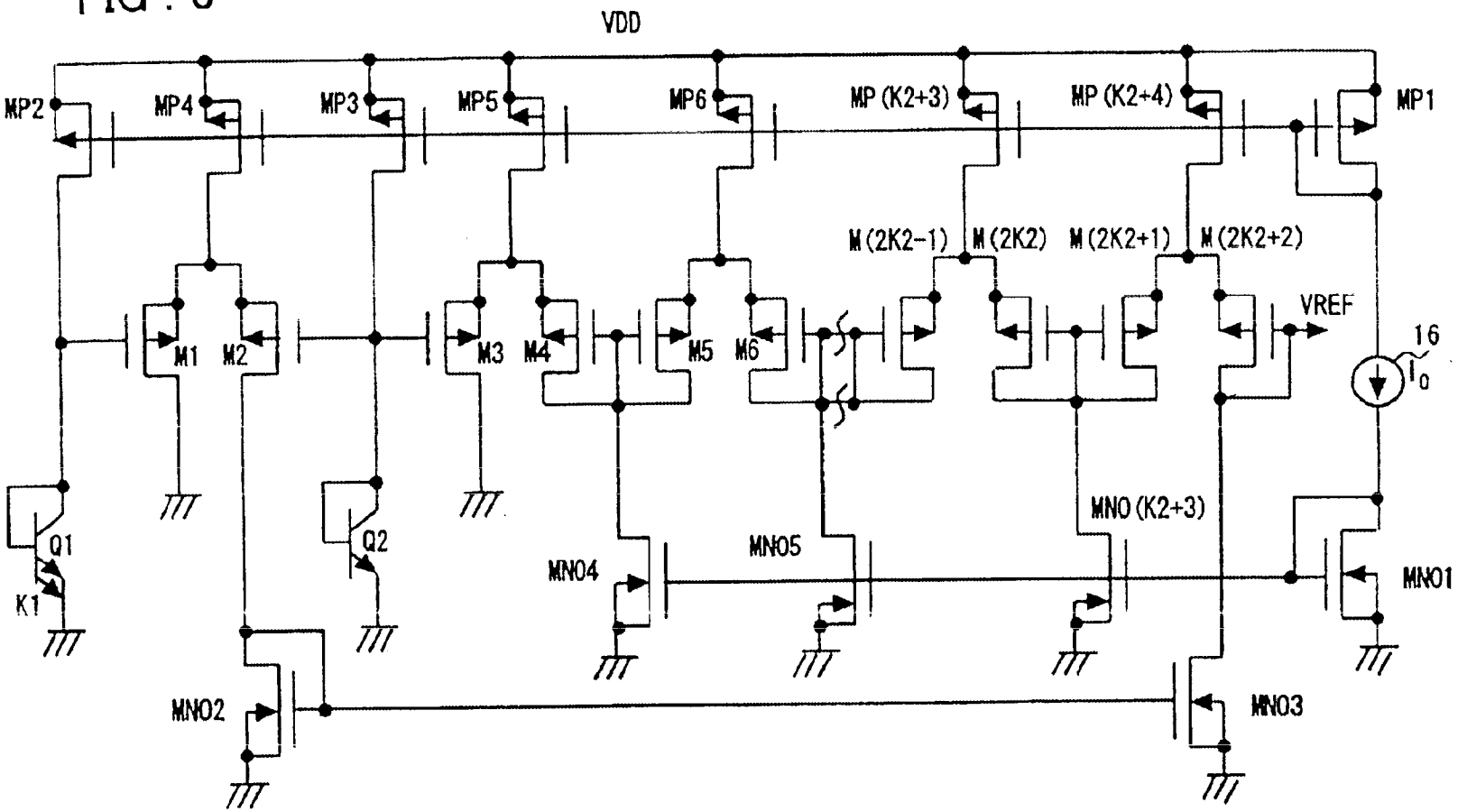
FIG. 6 shows a circuit structure of a third embodiment of the present invention.

In a modification of the present invention, as shown in FIGS. 5 and 6, plural differential pairs are connected in a cascaded configuration so that differential voltages applied to the differential input terminals of the respective differential pairs will be made equal to each other and equal to the differential voltage ΔV. From the differential pair of the last stage, a voltage equal to an integer number multiple of the differential voltage ΔV is obtained as a voltage proportional to absolute temperature.

Figure 7:
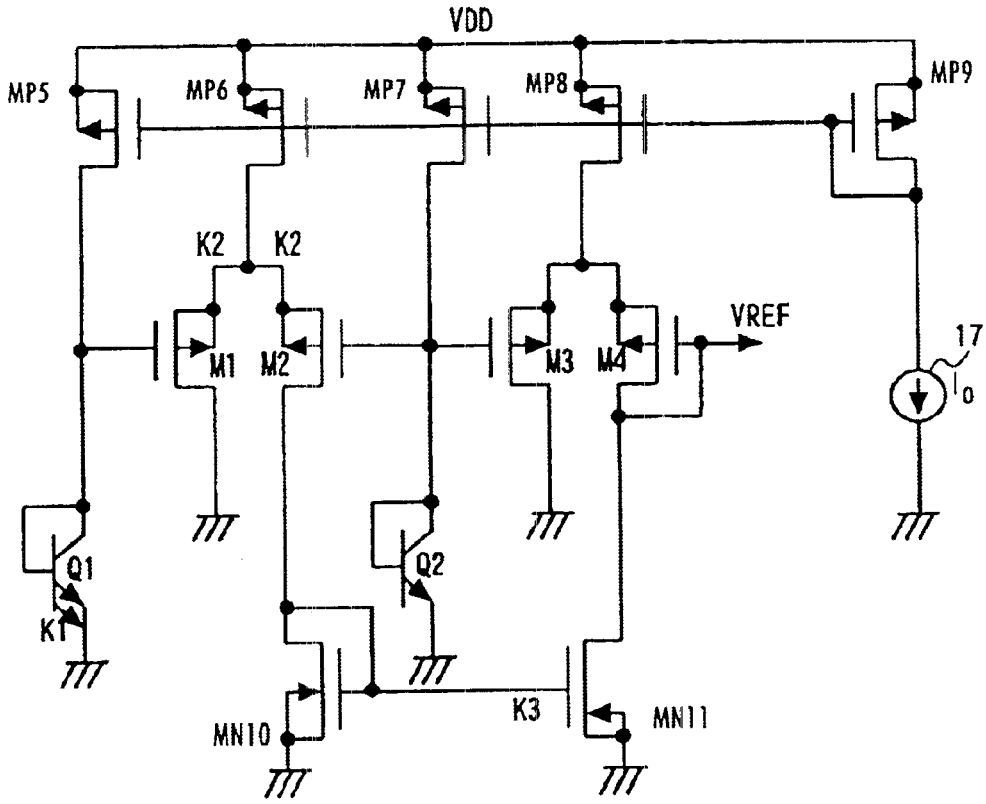
FIG. 7 shows a circuit structure of a fourth embodiment of the present invention.

Alternatively, a transfer curve (transfer characteristic) of the differential pairs may be normalized by a square root of a ratio of the driving current I0 to a transconductance parameter β of the differential transistor, or √(I0/β), and thus may be constant, as shown in FIG. 7

That is, if a normalized current equal to the normalized current flowing through one transistor of the first differential pairs M1 and M2 by the voltage applied to the first differential pairs M1 and M2 is caused to flow through one transistor of the second differential pair M3 and M4, the voltage across input terminals of the second differential pair is multiplied with the ratio of the standardized voltages of the two differential pairs, or divided by the ratio of the standardized voltages of the two differential pairs if the ratio is less than 1.

Therefore, the summation may be made as the voltage applied to the other input terminal of the second differential pair is multiplied with the voltage applied across the input terminals of the first differential pair.

Alternatively, an offset voltage VOS, generated in a voltage follower circuit, made up of an unbalanced differential pair, including unbalanced input differential pairs M1 and M2, active load devices M3 and M4, an output stage M5 and phase compensation circuits RC and CC, is obtained as a voltage VPTAT which is proportional to absolute temperature. In the operational amplifier which is driven with a constant current, the gate W/L ratio (gate width/gate length ratio) of the two transistors M1 and M2 constituting the input differential pair is 1:K2, and the gate W/L ratio of two transistors M3 and M4 (of a current mirror circuit configuration) forming an active load operating respectively as a load for two transistors M1 and M2, is K3:1, and the offset is added to an input voltage to the voltage follower circuit to produce an output reference voltage VREF. Alternatively, the gate W/L ratio of the two transistors forming the input differential pair is K2:1, while the gate W/L ratio of the two transistors forming an active load operating as a load for the two transistors is 1:K3, and an offset is subtracted from an input voltage to produce an output reference voltage VREF.

Such a configuration may also be used which includes a source-grounded MOS transistor MM10, having its drain and gate connected to one end and the other end of the resistor R1, respectively, a source-grounded MOS transistor MM11 having its gate connected to the drain of the MOS transistor MM10 and a current mirror circuit, having its input end connected to a drain of the MOS transistor MM11, and adapted for supplying the constant current to the MOS transistor MM10, a common source of the first and second MOS transistors MM1 and MM2 of the differential pair, a MOS transistor MM5 of a source follower configuration and to the collector of the bipolar transistor Q1.

Referring to the drawings, certain preferred embodiments of the present invention are explained in detail. FIG. 1 shows a circuit configuration of an embodiment of the present invention, as applied to a CMOS reference voltage circuit. As shown in FIG. 1, this circuit includes first and second emitter-grounded transistors Q1 and Q2, each of which has a base connected to a collector and is provided with a constant current at the collector, first and second operational transconductance amplifiers (abbreviate to OTAs) 11 and 12, each of which outputs current corresponding to the voltage difference between the voltage at a positive phase(non-inverting) input terminal (+) and that at a reverse phase (inverting) input terminal (−), and a current mirror circuit 13 which has a ratio of the current input to the input end to the current output from the output end equal to a predetermined value K2. The reverse phase input terminal (−) and the positive phase input terminal (+) of the first OTA 11 are connected to the collectors (more precisely the connection nodes of the collectors and the bases) of the first and second transistors Q1 and Q2, respectively. The first OTA 11 has its output terminal connected to an input end of the current mirror circuit 13. An output end of the current mirror circuit 13 and the collector of the second transistor Q2 are connected to the positive phase input terminal (+) and the reverse phase input terminal (−) of the second OTA 12, respectively, while the output terminal of the second OTA 12 is connected to the positive phase input terminal (+) of the second OTA 12. The reference voltage VREF is output at an output terminal of the second OTA 12.

It is assumed that, in the embodiment shown in FIG. 1, the emitter area of the transistor Q1 is K1 times the emitter area of the transistor Q2. The collectors of the transistors Q1 and Q2 are connected to drains of the P-channel MOS transistors M200 and M300, that is output terminals of a current mirror circuit(made up of P-channel MOS transistors M100, M200 and M300) which receives a constant current I0 from a constant current source 14 at its input terminal, and the current I0 flows through collectors of the transistors Q1 and Q2.

If the DC current amplification factor of the transistors is sufficiently close to unity and the base current is neglected, from the above equation (1), the base-to-emitter voltages VBE and VBE2 of the transistors Q1 and Q2 are expressed as follows:

$$VBE1 = VTln\{IC1/(K1 \cdot IS)\} = VTln\{I0/(K1 \cdot IS)\} \quad (9)$$

$$VBE2 = VTln(IC2/IS) = VTln(I0/IS) \quad (10)$$

The differential voltage ΔVBE between the base-to-emitter voltages VBE1 and VBE2 is given by:

$$\Delta VBE = VBE2 - VBE1 = VTln(K1) \quad (11)$$

That is, if the emitter grounded two transistors Q1 and Q2, both connected in diode configuration, are driven by the current mirror circuit, the densities of currents which flow respectively through the two transistors are rendered different as are the base-to-emitter voltages, and the differential voltage ΔVBE between the base-to-emitter voltages of the two transistors Q1 and Q2 is taken, the differential voltage ΔVBE is proportional to absolute temperature, thus producing a voltage proportional to the thermal voltage VT.

Also, as may be seen from the equation (12), in order to set current densities of two transistors different to produce a voltage differential between the base-to-emitter voltages of the two transistors Q1 and Q2, any of the following methods may be effectively used:

the emitter areas of the two transistors Q1 and Q2 are rendered different, as the driving currents supplied to the collectors of the two transistors Q1 and Q2 are kept equal;

the emitter areas of the two transistors Q1 and Q2 are rendered equal to each other and the driving currents supplied to the collectors of the two transistors Q1 and Q2 are rendered different; or both the driving currents and emitter areas of the two transistors Q1 and Q2 are rendered different.

Next, a multiplication-summation circuit, employing two OTASs, is described.

The first OTA 11 has a transconductance gm1 and receives the differential voltage VBE to draw the current gm1 ΔVBE. The second OTA 2 has a transconductance gm2 and has a reverse phase input terminal (−) for receiving the base-to-emitter voltage VBE2 of one of the transistors, while having a positive phase input terminal (+) connected in common with its output terminal and driven with a current K2×gm1 ΔVBE through the current mirror circuit 13.

Figure 2:
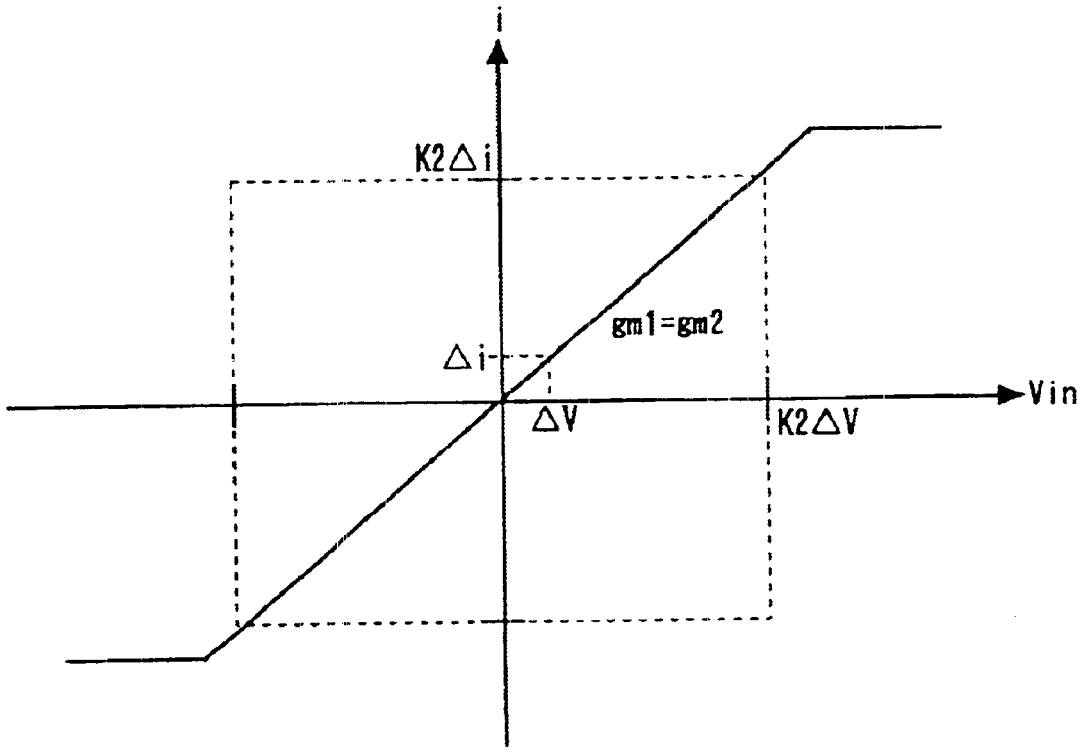
FIG. 2 illustrates the operation of multiplication of a reference voltage circuit embodying the present invention.

In order for the two OTAs to have the function of the voltage multiplication circuit, the OTAs need to be equal in transconductance (gm1=gm2), as shown in FIG. 2. If the current ratio (that is, input current value:mirror current value) of the current mirror circuit 13 is set to 1:K2 (K2>1), the voltage gain is K2 and, since the output current of the second OTA 12 is $$K2 \times gm1 \Delta VBE \quad (12),$$

the input differential voltage of the second OTA 12 is the output current divided by transconductance gm2, so that we have $$\Delta V = K2 \cdot gm1 \Delta VBE / gm2 = K2 \Delta VBE \quad (13)$$

Since in the second OTA, the output terminal for outputting the reference voltage VREF, is connected to the positive phase input terminal (+), the voltage of the reverse phase input terminal (−) is VBE2 and ΔV=(VREF−VBE2), the reference voltage VREF is given by:

$$VREF = VBE2 + K2 \Delta VBE = VBE2 + K2 \cdot VTln(K1) \quad (14)$$

In the equation (14), the base-to-emitter voltage VBE2 of the transistor Q2, driven with the constant current I0, has a negative temperature characteristic on the order of approximately −2 mV/° C., while the thermal voltage VT has a positive temperature characteristic on the order of approximately 0.0853 mV/° C.

Thus, in order for the output reference voltage VREF not to exhibit a temperature dependent characteristic, the temperature dependent characteristic might be cancelled with a voltage exhibiting a positive temperature characteristic and a voltage exhibiting a negative temperature characteristic.

That is, the value of K2 ln(K1) is 23.45, with the value of K2·VT ln(K1) being 0.61V. If VBE2 is 0.7V, $$\{VBE2+K2 \cdot VT \ln(K1)\}=1.31V.$$

Figure 3:
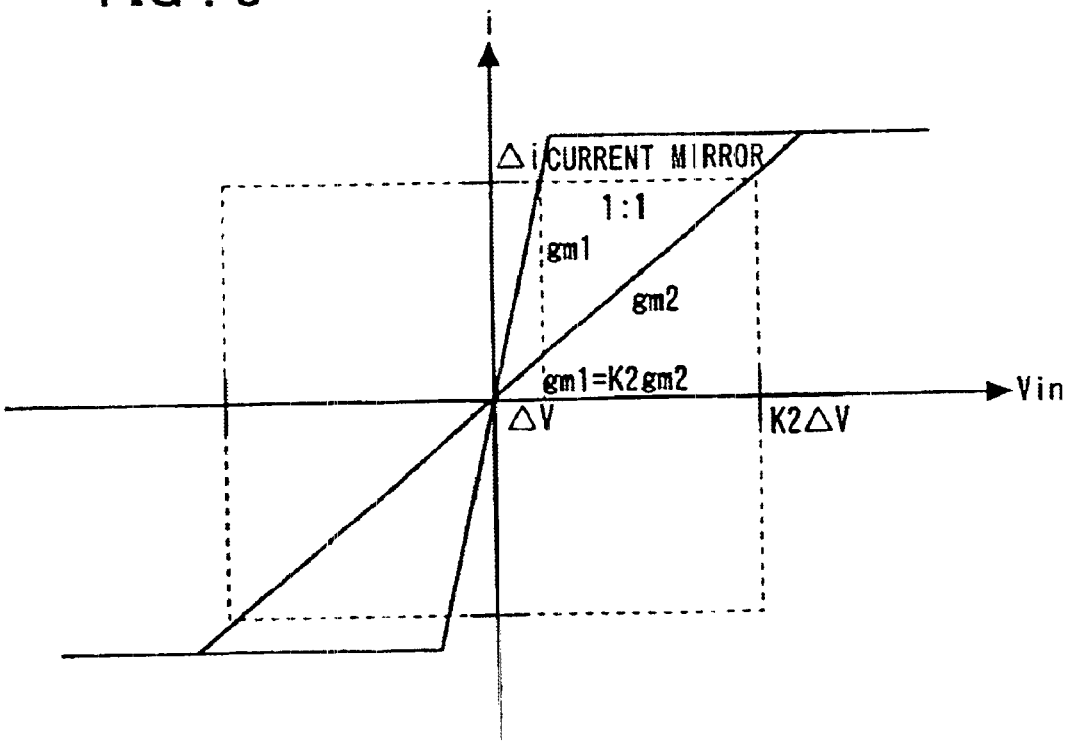
FIG. 3 illustrates the operation of multiplication of the reference voltage circuit embodying the present invention.

Alternatively, in order for these two OTA to have the function of a voltage multiplication circuit, as shown in FIG. 3, it is also sufficient if the two conductance values differ from each other such that $$gm1=K2gm2(K2>1)$$

and, when the current ratio of the current mirror circuit is set to 1:1, the voltage gain is K2, such that a differential voltage K2 ΔV is obtained as an output voltage:

$$K2\Delta V = gm1 \Delta VBE / gm2 = K2 \Delta VBE \quad (15)$$

Thus we have $$VREF = VBE2 + K2 \Delta VBE = VBE2 + K2 \cdot VTln(K1) \quad (16)$$

In the equation (16), the base-to-emitter voltage VBE2 of the transistor Q2, driven with the constant current I0, has a negative temperature characteristic on the order of approximately −2 mV/° C., while the thermal voltage VT has a positive temperature characteristic on the order of approximately 0.0853 mV/° C. Thus, in order for the output reference voltage VREF not to exhibit a temperature dependent characteristic, the temperature dependent characteristic might be cancelled with a voltage exhibiting a positive temperature characteristic and a voltage exhibiting a negative temperature characteristic.

That is, the value of K2 ln(K1) is 23.45, with the value of K2·VT ln(K1) being 0.61V. If VBE2 is 0.7V, we have $$\{VBE2+K2 \cdot VT \ln(K1)\}=1.31V.$$

Figure 4:
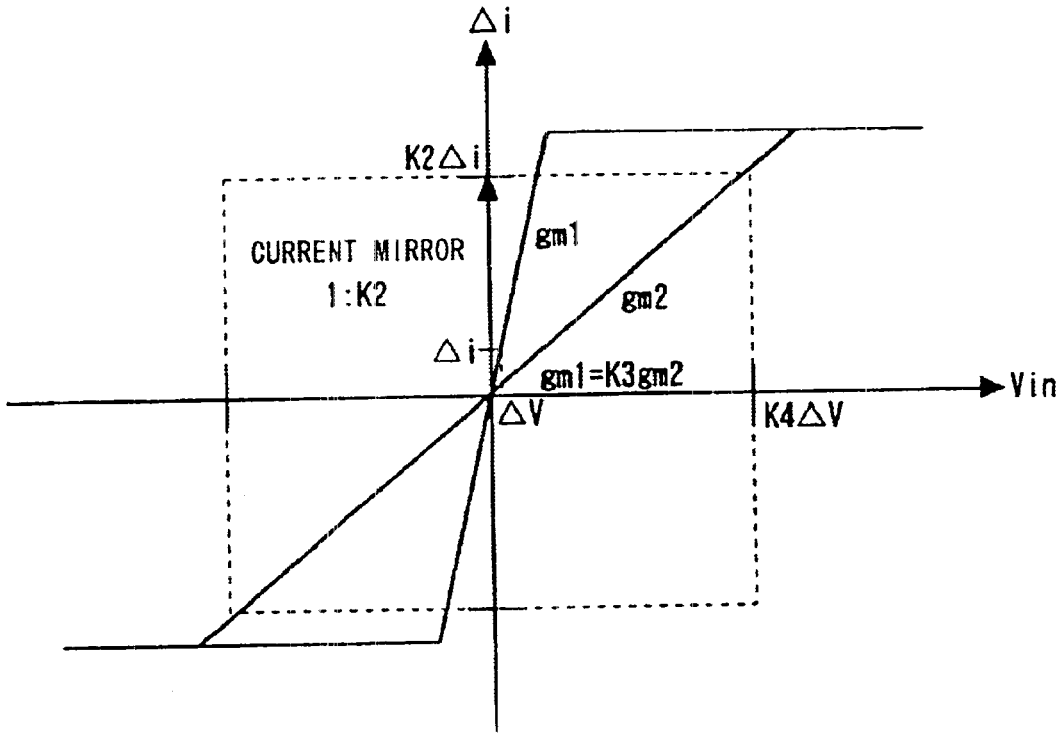
FIG. 4 illustrates the operation of multiplication of the reference voltage circuit embodying the present invention.

Alternatively, in order for the two OTA to have the function of a voltage multiplication circuit, as shown in FIG. 4, it is also sufficient if the two conductance values differ from each other, as shown in FIG. 4, such that $$gm1=K3gm2(K3>1)$$

and, when the current ratio of the current mirror circuit is set to 1:K2, the voltage gain is K4, such that a differential voltage K4 ΔV $$K4 \Delta V = K2gm1 \Delta VBE / gm2 = K2 \cdot K3 \Delta VBE \quad (17)$$

is obtained as the output voltage.

Thus, we have $$VREF = VBE2 + K4 \Delta VBE = VBE2 + K2 \cdot K3 \cdot VTln(K1). \quad (18)$$

In the equation (18), the base-to-emitter voltage VBE2 of the transistor Q2, driven with the constant current I0, has a negative temperature characteristic on the order of approximately −2 mV/° C., while the thermal voltage VT has a positive temperature characteristic on the order of approximately 0.0853 mV/° C. Thus, in order for the output reference voltage VREF not to exhibit a temperature dependent characteristic, the temperature dependent characteristic might be canceled by a voltage exhibiting a positive temperature characteristic and a voltage exhibiting a negative temperature characteristic.

That is, the value of K2·K3 ln(K1) is 23.45, with the value of K2·K3·VT ln(K1) being 0.61V. If VBE2 is 0.7V, we have $$\{VBE2+K2 \cdot K3 \cdot VT \ln(K1)\}=1.31V.$$

The second embodiment of the present invention will now be described. FIG. 5 shows a circuit configuration of a second embodiment of the CMOS reference voltage circuit according to the present invention. Referring to FIG. 5, this embodiment includes first and second diode-connected common emitter transistors Q1 and Q2, driven by two constant currents having a constant current ratio. The present embodiment also includes (K2+1) differential pairs as means for amplifying the differential voltage of the output voltages of the transistors Q1 and Q2 by a preset factor and summing the so amplified differential voltage to the output voltage (collector voltage) of the transistors Q1 and Q2.

The first differential pair M1 and M2 receives as a differential input a differential voltage of output voltages of the transistors Q1 and Q2.

An output voltage (collector voltage) of the transistor Q2 is applied to the gate of one transistors M3 of the second differential pair M3 and M4, with the other transistor M4 of the second differential pair being connected in a diode configuration. The second differential pair is driven with the current proportional to the output current of the one transistor M2 of the first differential pair.

In the third to number (K2+1) differential pairs, output voltages of the other diode-connected transistors M4 to M(2K2) of the preceding second to number K2 differential pairs are fed to the gates of the one transistors of the third to number (K2+1) differential pairs. These other transistors of the differential pairs are connected in diode configuration and are driven with the current proportional to the output current of the one transistor M2 of the first differential pair.

The first to number (K2+1) differential pairs are driven with constant (K2+1) currents respectively.

The output voltage of the diode-connected transistor M(2K2+2), of the transistors of the number (K2+1) differential pair, is output as the reference voltage VREF. The differential input voltages of the second to number (K2+1) differential pairs are summed together to attain a desired amplification factor.

Referring to FIG. 5, (K2+4) pieces of P-channel MOS transistors MP1 and MP2 to MP(K2+4), having sources connected in common to a power supply VDD and having gates connected in common, form a first mirror circuit having (K2+3) outputs. The P-channel MOS transistor MP1, the drain of which is connected to its gate has its drain connected to a constant current source 15. A constant current I0 is the input current to the first current mirror circuit. From the drains of the P-channel MOS transistors MP2 and MP3, the constant current is fed to the collectors of the first and second transistors Q1 and Q2, whereas, from the drains of the P-channel MOS transistors MP4 to MP(K2+4), the constant current is supplied to the sources of the first to number (K2+1) differential pairs. An N-channel MOS transistor MN01, having a source grounded, a drain connected to its gate and having the drain connected to the transistor M2, and N-channel MOS transistors MN02, MN03, . . . and MN0(K2+1) having sources grounded and having gates connected in common to the gate of the transistor MN01, make up a second current mirror circuit.

The gates of the transistors M1 and M2, forming a first differential pair, are supplied with the differential voltage ΔVBE between the base-to-emitter voltages VBE1 and VBE2 of the first and second diode-connected common emitter transistors Q1 and Q2. The drain of the transistor M1 is grounded, while the drain of the transistor M2 is connected to the drain of the N-channel MOS transistor MN01 which forms an input end of the second current mirror circuit.

Regarding transistors M3 and M4, which form the second differential pair, the gate of the transistor M3 is connected to the collector of the transistor Q2, and hence fed with the base-to-emitter voltage VBE2 of the transistor Q2. The gate and the drain of the other transistor M4 are connected in common (in a diode configuration) and connected to the drain of the N-channel MOS transistor MN02, while the transistor M4 is driven with a current proportional to the current flowing through the other transistor M2 forming the first differential pair. The input differential voltage, applied to the gates of the transistors M3 and M4 of the second differential pair, is equal to the input differential voltage applied to the gates of the transistors M1 and M2 of the first differential pair, and is equal to ΔVBE. The gate voltage of the MOS transistor M4 is the gate voltage of the MOS transistor M3 (the base-to-emitter voltage VBE2 of the transistor Q2) summed with ΔVBE, this voltage (VBE2+ΔVBE) being also fed to the gate of the one transistor M5 of the third differential pair. The other transistor M6 of the third differential pair is connected in a diode configuration and is connected to the drain of the output transistor MN03 of the second current mirror circuit. The differential voltage, fed to the gates of the transistors M5 and M6, is equal to the input differential voltage, applied to the gates of the transistors M1 and M2 of the first differential pair, and is equal to ΔVBE. The gate voltage of the transistor M6 is the gate voltage of the transistor M5 (VBE2+ΔVBE) summed with ΔVBE (VBE2+2ΔVBE), this voltage being input to the gate of one transistor of a fourth differential pair, not shown. The same holds for the third to number (K2+1) differential pairs. In each of the third to number (K2+1) differential pair, the differential input voltage is equal and the output voltage is higher by ΔVBE than the output voltage of the differential pair of the previous stage. The output voltage of the diode-connected other transistor of the number n stage differential pair is $$VBE2+(n-1)\times\Delta VBE.$$

The reference voltage VREF, which is an output voltage of the other diode-connected transistor M (2K2+2) of the number (K2+1) differential pair, is given by:

$$VBE2+K2\times\Delta VBE.$$

Thus, $$VREF = VBE2 + K2\,\Delta\,VBE \tag{19}$$

$$= VBE2 + K2\cdot VTln(K1).$$

In the equation (19), the base-to-emitter voltage VBE2 of the transistor Q2, driven with the constant current I0, has a negative temperature characteristic on the order of approximately −2 mV/° C., while the thermal voltage VT has a positive temperature characteristic on the order of approximately 0.0853 mV/° C.

Thus, in order for the output reference voltage VREF not to exhibit a temperature characteristic, it is sufficient if a voltage exhibiting a positive temperature characteristic and a voltage exhibiting a negative temperature characteristic cancels the temperature characteristic.

That is, the value of K2 ln(K1) is 23.45, with the value of K2·VT ln(K1) being 0.61V.

If VBE2 is 0.7V, $$\{VBE2+K2\cdot VT\ \ln(K1)\}=1.31V.$$

A third embodiment of the present invention is explained. FIG. 6 is a circuit diagram showing a third embodiment of the CMOS reference voltage circuit according to the present invention. Referring to FIG. 6, the present embodiment includes first and second diode-connected transistors Q1 and Q2, respectively grounded and driven by two constant currents having a constant current ratio to each other. As means for amplifying the differential voltage of the transistors Q1 and Q2 by a certain factor and summing the resulting amplified differential voltage to an output voltage of the first or second diode-connected transistor Q1 or Q2, (K2+1) differential pairs are arranged.

The first differential pair M1 and M2 is fed with a differential voltage of the output voltages of the transistors Q1 and Q2, while the second differential pair M3 and M4 is configured so that an output voltage of the transistor Q2 is applied to the one transistor M3 of the differential pair, with the other transistor M4 thereof being connected in a diode configuration.

The differential transistors M5 and M6 to M(2K2−1) and M(2K2) of the third to number K2 differential pairs are all connected in a diode configuration, in such a manner that a diode-connected transistor of the differential pair of the front stage and the diode-connected transistor of the differential pair of the back side stage are driven at a constant current with a constant current ratio K2, while the number M(2K+1) and M(2K+2) transistors of the number (K2+1) differential pair are all connected in a diode configuration. The diode connected number M(2K2+1) transistor is driven at a constant current along with the diode-connected transistor M (2K2) of the front stage, while the diode-connected other transistor M(2K2+2) is driven with the current proportional to one output current of the first differential pair The number 1 to number (K2+1) differential pairs is driven at a constant current (K2+1) with a constant current ratio. The desired amplification factor is achieved by summing all of the differential input voltages of the second to number (K2+1) differential pairs.

Referring to FIG. 6, (K2+4) common gate P-channel MOS transistors MP1, MP2 to MP(K2+4), having respective sources connected to a power supply VDD in common, constitute a first current mirror circuit having (K2+3) outputs. The P-channel MOS transistor MP1, having its drain connected to its gate has the drain connected to a constant current source 16 with a constant current I0 being an input current to the first current mirror circuit. The drains of the P-channel MOS transistors MP2 and MP3 output a constant current to the collectors of the first and second transistors Q1 and Q2, while the drains of the P-channel MOS transistors MP4 to MP(K2+4)3 output a constant current to the common source of the number 1 to number K2+1 differential pairs. The transistor MN01, having its source grounded, having its drain connected to its gate, having the drain connected to the constant current source IO and fed with the sink current, and the N-channel MOS transistors MN04, MN05 and MN0(K2+3), having the sources grounded and having the gates to the gate of the transistor MN01 in common, constitute a second current mirror circuit. The transistor MN02, having its source grounded, having its drain connected to its gate, and having the drain connected to the drain of the transistor M2, and an N-channel MOS transistor MN03, having its source grounded and having its gate connected to the gate of the transistor MN02 in common, constitute a third current mirror circuit.

In FIG. 6, the first differential pair, made up of P-channel MOS transistors M1 and M2, is fed with a differential input voltage corresponding to a differential voltage ΔVBE between the base-to-emitter voltage VBE1 of the transistor Q1 and the base-to-emitter voltage VBE2 of the transistor Q2.

Also, in the second differential pair, made up of the transistors M3 and M4, the transistor M3 has its gate fed with the base-to-emitter voltage VBE2 of the transistor Q2, while the transistor M4 has its gate connected to its drain in a diode configuration and also connected to a gate of the transistor M5 which constitutes a third differential pair and has its gate connected to its drain in a diode configuration. The transistor M4 and M5 are driven with a constant current.

The third to number K2 differential pairs are configured in similar manner. The diode-connected transistor M(2K+2) of the number K2+1 last-stage differential pair has its drain connected to the drain of the output transistor MN03 of the third current mirror circuit, and is driven by the current proportional to that flowing in the transistor M2 of the first differential pair.

The first differential pair (made up of transistors M1 and M2) is driven by the transistor MP4 with a current Io proportional to the constant current I0. If a differential voltage ΔVBE is differentially input to the first differential pair, and the drain currents flowing through the transistors M1 and M2 of the first differential pair are I1 and I2, we have $$I1+I2=Io.$$

The common source of the transistors M(2K2+1) and M(2K2+2) of the last-stage number (K2+1) differential pair is fed with the current Io from the transistor MP(K2+4), the drain of the transistor M(2K2+2) is driven by the transistor MN03 with the current I2, with the current Io−I2=I1 flowing through the drain of the transistor M(2K2+1). The differential input voltage of the number (K2+1) is ΔVBE, with the gate voltage of the transistor M(2K2+1) being lower by ΔVBE than the gate voltage of the transistor M(2K2+2).

The drains of the transistor M(2K2+1) of the number (K2+1) differential pair and the drain of the transistor M(2K2) of the number (K2) differential pair are connected in common to the drain of the output transistor MN0(K2+3) of the second current mirror circuit. Since these transistors are driven with the current Io proportional to the constant current I0, the current flowing through the drain of the transistor MP(2K2) is Io−I1=I2, while the current flowing through the drain of the transistor MP(2K2−1) is Io−I2=I1. As in the case of the first differential pair, the differential input voltage is ΔVBE, with the gate voltage of the transistor MP(2K2−1) being lower by ΔVBE than the gate voltage of the transistor M(2K2). In this manner, the gate voltages of the diode-connected transistors are lowered stepwise by ΔVBE up to the second differential pair M3 and M4.

Since the voltage input to the gate of the transistor M3 of the second differential pair is the base-to-emitter voltage VBE2 of the transistor Q2, the drain (gate) voltage of the transistor M4 of the second differential pair is VBE2+ΔVBE, so that the output voltage VREF of the transistor M(2K2+2) of the number (K2+1) stage differential pair is $$\begin{aligned} VREF &= VBE2 + K2\,\Delta\,VBE \\ &= VBE2 + K2 \cdot VTln(K1). \end{aligned} \tag{20}$$

In the equation (20), the base-to-emitter voltage VBE2 of the transistor Q2, driven with the constant current Io, has a negative temperature characteristic on the order of approximately −2 mV/° C., while the thermal voltage VT has a positive temperature characteristic of 0.0853 mV/° C.

Therefore, in order that the output reference voltage VREF will not exhibit a temperature characteristic, it is sufficient if a voltage exhibiting a positive temperature characteristic and a voltage exhibiting a negative temperature characteristic ekes out the temperature characteristic. That is, the value of K21 ln(K1) is 23.45, while that of K2·VT ln(K1) is 0.57V.

If VBE2 is 0.7 V, $$\{VBE2+K2 \cdot VT\ \ln(K1)\}=1.31V.$$

A fourth embodiment of the present invention is now explained. FIG. 7 shows a circuit structure of a fourth embodiment of a CMOS reference current circuit of the present invention. In the present embodiment, a multiplication summation circuit employing two differential pairs is described.

The embodiment shown in FIG. 7 includes first and second diode-connected transistors Q1 and Q2, both of which have emitters, grounded and are driven with two constant currents bearing a constant current ratio to each other. The present embodiment also includes means, made up of two differential pairs, for amplifying the differential voltage of the output voltages of the two transistors Q1 and Q2 by a preset constant factor and summing the result to an output voltage from the transistor Q2.

The differential pair made up of P-channel MOS transistors M1 and M2 receives a differential voltage of output voltages of the transistors Q1 and Q2. An output voltage of the transistor Q2 is applied to the gate of the P-channel MOS transistor M3 making up a second differential pair along with the diode-connected P-channel MOS transistor M4. The drain of the transistor M4 is driven with a current proportional to an output current of the first differential pair, that is the drain current of the transistor M2 (K3 tuple current). The common source of the first and second differential pairs is driven with two constant currents, having a certain current ratio to each other. A desired amplification factor is realized by setting the operating input voltage range of the second differential pair so as to be a preset constant number tuple of that of the first differential pair. In FIG. 7, P-channel MOS transistors M5 to M9, which have their sources connected in common to a power supply VDD and have their gates connected in common, constitute a first current mirror circuit. The P-channel MOS transistor M9, having its drain connected to its gate has the drain connected to a constant current source 17, with the constant current I0 being an input current to the current mirror circuit. From the drains of the P-channel MOS transistors MP5 and MP7, constant currents are fed to the collectors of the first and second transistors Q1 and Q2, and from the drains of the P-channel MOS transistors MP6 and MP8, constant currents are fed to the commonly connected sources of the first and second differential pairs respectively. An N-channel MOS transistor MN10, having a source grounded, having a drain and a gate connected to each other and having the drain connected to the drain of the transistor M2, and an N-channel MOS transistor MN11, having a source grounded and having a gate connected to the gate of the transistor MN10, constitute a second current mirror circuit.

It is assumed that a transconductance parameter β is equal for both the transistors M1 and M2, forming the first differential pair, and that the two transistors are driven at the constant current I0, where the transconductance parameter β is given by:

$$\beta=\mu(Cox/2)(W/L)$$

where $\mu$ is the effective mobility of the carrier, Cox is the capacity of a gate oxide film per unit area and W and L are a gate width and a gate length, respectively. The gate W/L ratio of the transistors M1 and M2, forming the first differential pair, where W and L denote the gate width and the gate length, respectively, is set so as to be K2 times the gate W/L ratio of the transistors M3 and M4 forming the second differential pair.

The respective drain currents ID1 and ID2 of the transistors M1 and M2 are given by:

$$I_{D1}=\beta(V_{GS1}-V_{TH})^2 \quad (21)$$

$$I_{D2}=\beta(V_{GS2}-V_{TH})^2 \quad (22),$$

respectively. In the above equations, $V_{GS1}$ and $V_{GS2}$ denote the gate-to-source voltages of the transistors M1 and M2 respectively and $V_{TH}$ is a threshold voltage.

The sources of the transistors M1 and M2 are connected to the drain of the P-channel MOS transistor MP6, forming an output of the first current mirror circuit. From the conditions for the driving current, $$I_{D1}+I_{D2}=I_0 \quad (23)$$

By solving equation (21) to (23), ID1 and $I_{D2}$ are given by the following equation (24) and (25):

$$I_{D1}=\frac{1}{2}\left\{I_0+\beta\Delta V\sqrt{\frac{2I_0}{\beta}-(\Delta V)^2}\right\} \quad (24)$$

$$I_{D2}=\frac{1}{2}\left\{I_0+\beta\Delta V\sqrt{\frac{2I_0}{\beta}-(\Delta V)^2}\right\} \quad (25)$$

In the above equations, $\Delta V=V_{GS1}-V_{GS2}$.

If the equation (24) and (25) are normalized with the current I0, the following equations (26) and (27) are obtained:

$$f_{D1}(x)=\frac{I_{D1}}{I_0}=\frac{1}{2}\left\{1+\sqrt{2}\sqrt{1-\frac{x^2}{2}}\right\} \quad (26)$$

$$f_{D2}(x)=\frac{I_{D2}}{I_0}=\frac{1}{2}\left\{1-\sqrt{2}\sqrt{1-\frac{x^2}{2}}\right\} \quad (27)$$

where $$x=\Delta V/\sqrt{I_0/(K_2\beta)}$$

In the second differential pair, made up by the transistors M3 and M4, the above equations are given by:

$$f_{D3}(x)=\frac{I_{D3}}{K_3 I_0}=\frac{1}{2}\left\{1+\sqrt{2}\sqrt{1-\frac{x^2}{2}}\right\} \quad (28)$$

and $$f_{D4}(x)=\frac{I_{D4}}{K_3 I_0}=\frac{1}{2}\left\{1-\sqrt{2}\sqrt{1-\frac{x^2}{2}}\right\} \quad (29)$$

where $$x=\Delta V/\sqrt{K_3 I_0/\beta}$$

The above normalization enables the application not only to the first differential pair, made up of the transistors M1 and M2, but also to the second differential pair, made up of the transistors M3 and M4.

It is assumed that, with the first differential pair, comprised of the transistors M1 and M2, $$x_1=\Delta V_1/\sqrt{I_0/(K_2\beta)}$$

and, with the second differential pair, made up of the transistors M3 and M4, $$x_2=\Delta V_2/\sqrt{K_3 I_0/\beta}$$

Since the drain current ID2 of the transistor M2 is K-tupled to flow through the transistor M4, with the current ratio in the second current mirror circuit being K3, the normalized input voltages are equal to each other, so that x1=x2. Consequently, $$\Delta V_2=\Delta V_1\frac{\sqrt{\frac{K_3 I_0}{\beta}}}{\sqrt{\frac{I_0}{(K_2\beta)}}}=\sqrt{K_2 K_3}\,\Delta V_1 \quad (30)$$

with the multiplication coefficient being $$\sqrt{K_2K_3}$$

Since $$\Delta V1=\Delta V=\Delta VBE=VTln(K1) \quad (31)$$

$$V_{REF}V_{BE2}+\Delta V_2V_{BE2}+\sqrt{K_2K_3}V_T\ \ln(K_1) \quad (32)$$

The thermal voltage VT has a positive temperature characteristic of 0.0853 mV/° C. If, assuming that the transistor Q2 is being driven with the constant current I0, exhibiting a low temperature characteristic, the temperature characteristic of the base-to-emitter voltage VBE of the transistor Q2 is −2.0 mV/° C., and if it is desired for the output reference voltage VREF not to display a temperature characteristic, it is sufficient if the temperature characteristic are cancelled out by a voltage exhibiting a positive temperature characteristic and a voltage exhibiting a negative temperature characteristic.

That is, the value of Sqrt(K2×K3)×in(K1) is 23.447, where the function Sqrt( ) denotes √( ).

The value of Sqrt(K2×K3)×VT ln(KI) is 0.60 V at ambient temperature.

If VBE2 is 0.7V, $$\{VBE2+Sqrt(K2K3)\times VT\ \ln(K1)\}=1.3V.$$

Specifically,

K1=10,

K2=8, and

K3=13.

Figure 8:
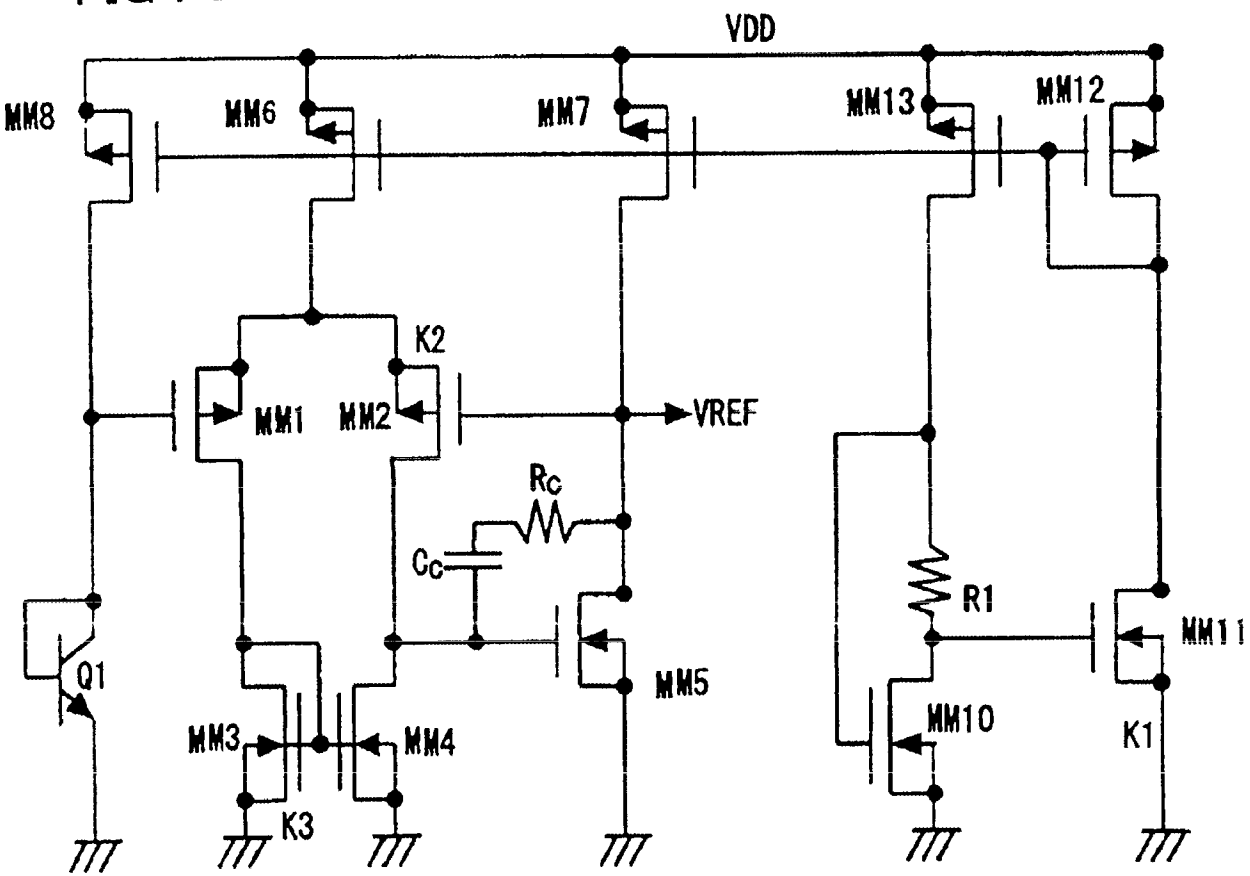
FIG. 8 shows a circuit structure of a fifth embodiment of the present invention.

A fifth embodiment of the present invention is now explained. FIG. 8 shows a circuit structure of a fifth embodiment of the present invention.

In FIG. 8, transistors MM1 to MM7 constitute a voltage follower type operational amplifier with a resistance for compensation RC and a capacity for compensation CC. The W/L ratio of input differential transistors MM1 and MM2 is set to 1:K2, and the W/L ratio of active load transistors MM3, and MM4, operating as loads, is set to K3:1, so that input offset is produced. The transistors MM1 and MM2, having sources connected in common to a drain of the constant current source transistor MM6, form a differential pair. The transistor MM3, connected to the drain of transistor MM1, and having its source grounded, and the transistor MM4, having its drain connected to the drain of the transistor MM2, having its source grounded and having its gate connected to the gate of the transistor MM3, form a current mirror circuit operating as a load for the differential pair. The drain of the transistor MM2, forming an output of the differential pair, is connected to the gate of the transistor M5, the drain of which is connected to a drain of the constant current source transistor MM7. An output voltage VREF is taken at a drain of the transistor MM5, operating as an output terminal. The output terminal is connected to the gate of the transistor MM2 that operates as an inverting input terminal of the differential pair. A resistor RC for phase compensation and a capacity CC are connected across the drain and the gate of the transistor MM5. A base-to-emitter voltage VBE of the transistor Q1 is input to a non-inverting input terminal of the differential pair.

Since a correct resistance value is not required of the resistor RC for phase compensation, the resistor is usually replaced by a P-channel MOS transistor and an N-channel MOS transistor.

The drain currents ID1 and ID2 of the respective transistors MM1 and MM2 are given by:

$$I_{D1}=\beta(V_{GS1}-V_{TH})^2 \quad (33)$$

$$I_{D2}=K3\beta(V_{GS2}-V_{TH})^2 \quad (34)$$

The following relationship holds:

$$I_{D1}+I_{D2}=I_0 \quad (35)$$

Also, we can postulate:

$$V_{OS}=V_{GS1}-V_{GS2} \quad (36)$$

Moreover, from the conditions of the active load transistors MM3 and MM4, we have $$K3I_{D1}I_{D2} \quad (37)$$

Solving the equations (35) and (37), $$I_{D1}=I_0K3/(K3+1) \quad (38)$$

$$I_{D2}=I_0/(K3+1) \quad (39).$$

Thus, solving the above equation, we obtain:

$$V_{OS}=\sqrt{\frac{I_0}{\beta}}\sqrt{\frac{K_3}{K_3+1}}\left(1-\frac{1}{\sqrt{K_2K_3}}\right) \quad (40)$$

Since the respective terms containing Kj are constants not dependent on the temperature, the temperature characteristic of the term of Sqrt(I0/β) are at issue. Since mobility $\mu$ exhibits temperature dependent characteristic in the case of the MOS transistor, the temperature dependency of the transconductance parameter β may be given by the following equation:

$$\beta=\beta_0\left(\frac{T}{T_0}\right)^{-\frac{3}{2}} \quad (41)$$

where $\beta_0$ is the value of $\beta_0$ at an ambient temperature (300K). Of the temperature characteristic of the term Sqrt (I0/β), the temperature characteristic of the term β have become apparent. Next, the temperature characteristic of the constant current I0 must be defined.

The generally used MOS reference current circuit may be implemented by self-biasing non-linear current mirror circuits, such as Nagata current mirror circuit, Widlar current mirror circuit, or an reverse Widlar current mirror circuit, as shown in FIG. 8.

FIG. 8 shows a MOS reference current circuit, which is made up of a self-biased Nagata current mirror circuit.

A circuit comprised of a transistor MM10, having a source grounded, a drain connected to one end of a resistor R1 and having a gate connected to the opposite end of the resistor R1, a transistor MM11, having a source grounded and having a gate connected to the drain of the transistor MM10, and the resistor R1, makes up a Nagata current mirror circuit. Here, with the transistors MM13 and MM12 forming a current source, the transistors MM10 and MM11 and the resistor R1 form a self-biased Nagata current mirror circuit00.

Here, the transistor MM10 is assumed to be a unit transistor, and the ratio of the gate width W to gate length L, or (W/L), of the transistor MM11, is assumed to be K1 times that of the unit transistor, where K1>1.

In the MOS Nagata current mirror circuit, shown in FIG. 8, the device is assumed to exhibit satisfactory matching, the channel length modulation and the substrate effect are neglected, and the relationship between the drain current and the gate-to-source voltage of the MOS transistor is assumed to follow the square rule. Then, the drain current ID1 of the MOS transistor MM10 is given by:

$$I_{D1}=\beta(V_{GS10}-V_{TH})^2 \quad (42).$$

The drain current ID2 of the MOS transistor MM11 is given by:

$$I_{D2}=K1\beta(V_{GS11}-V_{TH})^2 \quad (43)$$

There is also the following relationship:

$$V_{GS10}=V_{GS11}+R1I_{D10} \quad (44).$$

Solving the equation (44) from the equation (42), the relationship between the input and output currents of the MOS Nagata current mirror circuit is given by:

$$I_{D11} = K_1\beta R_1^2 I_{D10}\left(\sqrt{I_{D10}} - \frac{1}{R_1\sqrt{\beta}}\right)^2 \quad (45)$$

The MOS Nagata current mirror circuit features a region where the output current (mirror current) is monotonously increased against the input current (reference current), a peak point and a region where the output current (mirror current) is monotonously decreased against the input current (reference current).

On differentiating ID11 with respect to ID10, the ID11 reaches a peak point at $$ID11=K1\times ID10/4 \text{ for } ID10=1/(4R1^2\beta).$$

Thus, if K1=4, $$\text{ID11}=\text{ID10}.$$

It is noted that transistors MM11 and MM10 make up a current mirror circuit, while the transistors MM13 and MM12 drive MM10 and MM11, respectively. Thus, the transistors MM11 and MM10 make up a MOS self-biased Nagata reference current circuit, with $$I_{D10}=I_{D11} \quad (46)$$

Thus, $$\Delta V_{GS}=V_{GS10}-V_{GS11}=R_1I_{D10} \quad (47)$$

Solving the equation (39) from the equation (37), $$I_{D10} = I_{D11} = \frac{1}{R_1^2\beta}\left(1 - \frac{1}{\sqrt{K_1}}\right)^2 \quad (48)$$

where K1 is a constant not having a temperature characteristic. Since mobility $\mu$ exhibits a temperature characteristic in the case of the MOS transistor, the temperature dependency of the transconductance parameter β may be represented by the following equation:

$$\beta = \beta_0\left(\frac{T}{T_0}\right)^{-\frac{3}{2}} \quad (49)$$

$\beta_0$ is the value of $\beta_0$ at an ambient temperature (300K). Therefore, $$\frac{1}{\beta} = \frac{1}{\beta_0}\left(\frac{T}{T_0}\right)^{\frac{3}{2}} \quad (50)$$

The temperature coefficient of 1/β is 5000 ppm/° C. at ambient temperature. This value is approximately 1.5 times 3333 ppm/° C., which is the value of the temperature coefficient of the thermal voltage VT of the bipolar transistor.

Also, the transistor MM12 forms a current mirror circuit with the transistor MM13, so that $$I_{D12}=I_{D13} \quad (51).$$

That is, the output current I0 of the CMOS reference voltage circuit may be found by:

$$I_0 = I_{D10} = I_{D11} = \frac{1}{R_1^2\beta_0}\left(\frac{T}{T_0}\right)^{\frac{3}{2}}\left(1 - \frac{1}{\sqrt{K_1}}\right)^2 \quad (52)$$

where K1 is a constant not having a temperature characteristic. The temperature characteristic of 1/β is approximately proportional to temperature, as mentioned above, and is 5000 ppm/° C. at ambient temperature. This value is approximately 1.5 times 3333 ppm/° C., which is the value of the temperature characteristic of the thermal voltage VT of the bipolar transistor.

Thus, it may be seen that, if a temperature coefficient of the resistor R1 is less than or equal to 5000 ppm/° C. and linear as regards the temperature, the drain current ID10 exhibits a positive temperature coefficient, with the output current I0 of the reference current circuit, output by the current mirror circuit, being proportional to temperature, so that the circuit operates as a PTAT current source circuit.

Although a startup circuit is needed for starting-up the self-bias circuit, this is omitted for simplicity in the previous explanation on the operation. For a simplified startup circuit, references may be made to the publication such as JP PATENT KOKAI JP-A-8-314561(U.S. Pat. No. 2,800,720), by the same inventor as the present application.

The output current of the CMOS reference current circuit is as shown in the equation (52), while its temperature characteristic has now become apparent. Consequently, by substituting the equation (52) into the equation (40), we obtain:

$$\begin{aligned} V_{OS} &= \frac{1}{R_1\beta}\left(1 - \frac{1}{\sqrt{K_1}}\right)\sqrt{\frac{K_3}{K_3+1}}\left(1 - \frac{1}{\sqrt{K_2K_3}}\right) \\ &= \frac{1}{R_1\beta_0}\left(\frac{T}{T_0}\right)^{\frac{3}{2}}\left(1 - \frac{1}{\sqrt{K_1}}\right)\sqrt{\frac{K_3}{K_3+1}}\left(1 - \frac{1}{\sqrt{K_2K_3}}\right) \end{aligned} \quad (53)$$

where the respective terms containing Kj are constants not exhibiting a temperature characteristic and an offset voltage VOS is determined by the resistor R1 determining the current value of the CMOS reference voltage circuit, the temperature characteristic of 1/β, which is 5000 ppm/° C. at ambient temperature. If the temperature characteristic of the resistor R1 is sufficiently smaller than 5000 ppm/° C., the offset voltage exhibits a temperature characteristic of 5000 ppm/° C. at ambient temperature. This value is approximately 1.5 times 3333 ppm/° C., which is the value of the temperature characteristic of the thermal voltage VT of the bipolar transistor. Consequently, a reference voltage lower than the output voltage of the reference voltage circuit shown in FIG. 7 is obtained as now explained.

In FIG. 8, the output voltage VREF of the reference voltage circuit is given by:

$$VREF=VBE1+VOS \quad (54).$$

The transistor Q1 is driven with a constant current having a temperature characteristic of approximately 5000 ppm° C.

Therefore, if it is assumed that the temperature characteristic for the VBE of the bipolar transistor is slightly less stringent than −1.9 mV/° C. as explained with reference to FIG. 7, and is slightly smaller than −1.9 mV/° C., for example, in the vicinity of −1.85 mV/° C., the temperature characteristic of the output voltage VREF of the reference voltage circuit is given by:

$$\frac{1}{R_1\beta_0}\left(1-\frac{1}{\sqrt{K_1}}\right)\sqrt{\frac{K_3}{K_3+1}}\left(1-\frac{1}{\sqrt{K_2K_3}}\right)=0.37\text{ V} \quad (55)$$

in case the temperature characteristic of VBE1 of −1.85 mV/° C. and that of VOS of 500 ppm/° C. cancel each other.

If, in this case, VBE1=0.7 V, the output voltage VREF of the reference voltage circuit shown in FIG. 8 is given by:

$$VREF=1.07V \quad (56).$$

Since the circuit of the present embodiment takes the configuration of a voltage follower type operational amplifier, it is possible to subtract the offset voltage. In this case, the connection of various circuit components may be kept unchanged as shown in FIG. 8 and only the gate W/L ratio of the transistors MM1 and MM2 and the gate W/L ratio of the transistors MM3 and MM4 are changed to K2:1 and to 1:K3, respectively. The output voltage VREF of the reference voltage circuit in this case is given by:

$$VREF=VBE1-VOS \quad (57).$$

Thus, if the offset voltage shown by the equation (57) is subtracted, the output voltage VREF of the reference voltage circuit for VBE1=0.7 V is given by:

$$VREF=0.33V \quad (58)$$

it being noted that the output voltage VREF of the reference voltage circuit exhibits a negative temperature characteristic of −3.7 mV° C.

Figure 9:
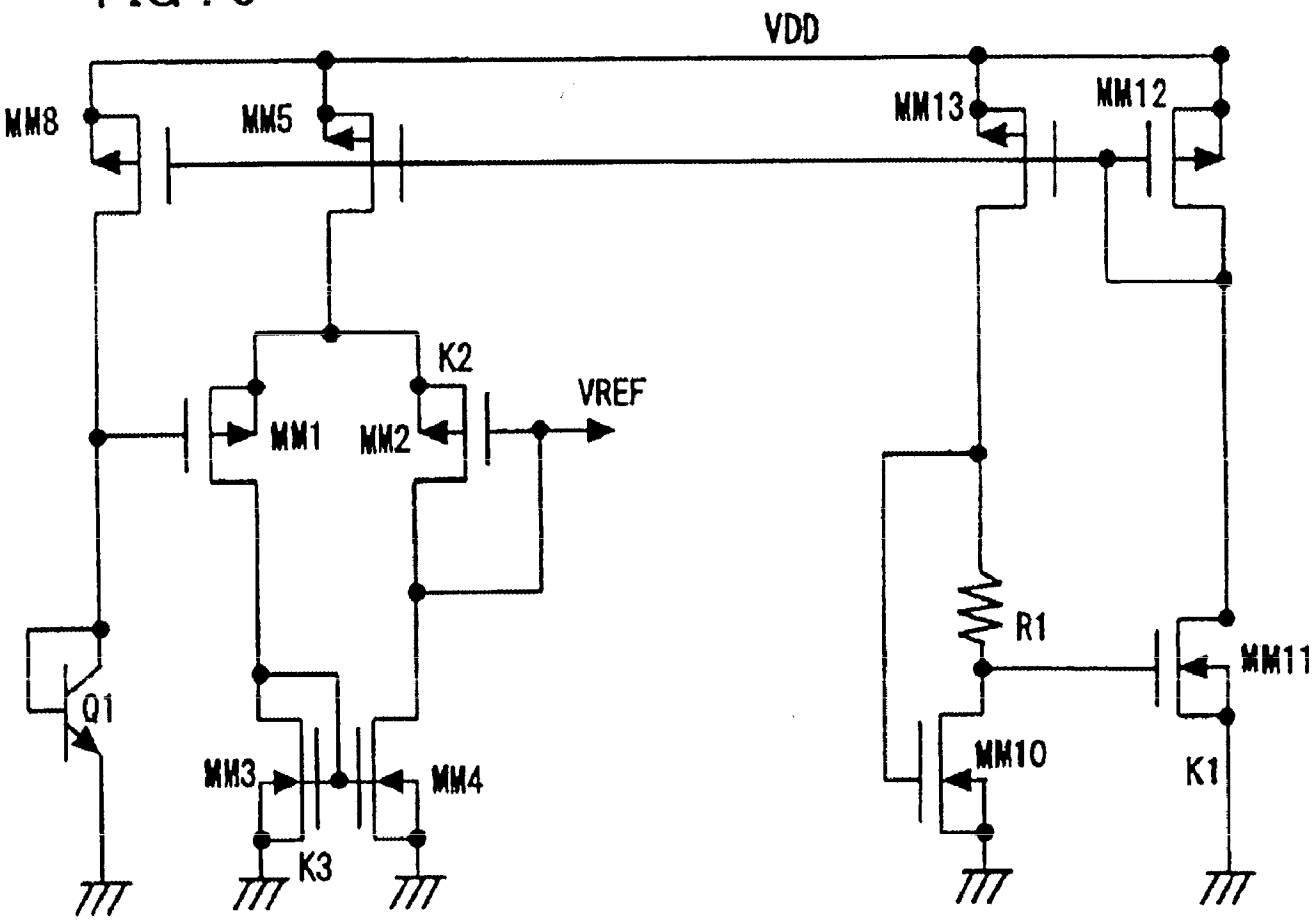
FIG. 9 shows a modification of the fifth embodiment of the present invention.

FIG. 9 shows a modification of the embodiment shown in FIG. 8. The drain and the gate of the transistor MM2 of the differential pair are connected together and the output VREF is taken out from the drain. In FIG. 9, the output voltage VREF of the reference voltage circuit is given by:

$$VREF=VBE+V_{OS},$$

as in equation (54), where $V_{OS}$ is given by the equation (53). That is, a reference voltage not dependent upon temperature is output, as mentioned above. Although this modification lacks in capability of feeding a current from the reference voltage output terminal, it is effective as a voltage source for supplying the reference voltage.

In the above-described embodiments, the diode-connected bipolar transistors Q1 and Q2 may well be replaced by diodes. A Bi-CMOS circuit in which the bipolar transistor and the MOS transistors are constructed on one and the same substrate may also construct it. Although the present invention has been explained based on the above-described embodiments, the present invention is not limited to the particular structure shown therein and may, of course, be modified or corrected by those skilled in the art within the scope of the invention as defined by the claims.

The meritorious effects of the present invention are summarized as follows.

As described above, the present invention gives the following effects:

The first effect of the present invention is that a reference voltage circuit having an output voltage of 1.2 V and not exhibiting a temperature characteristic may readily be implemented by the CMOS process.

Figure 10:
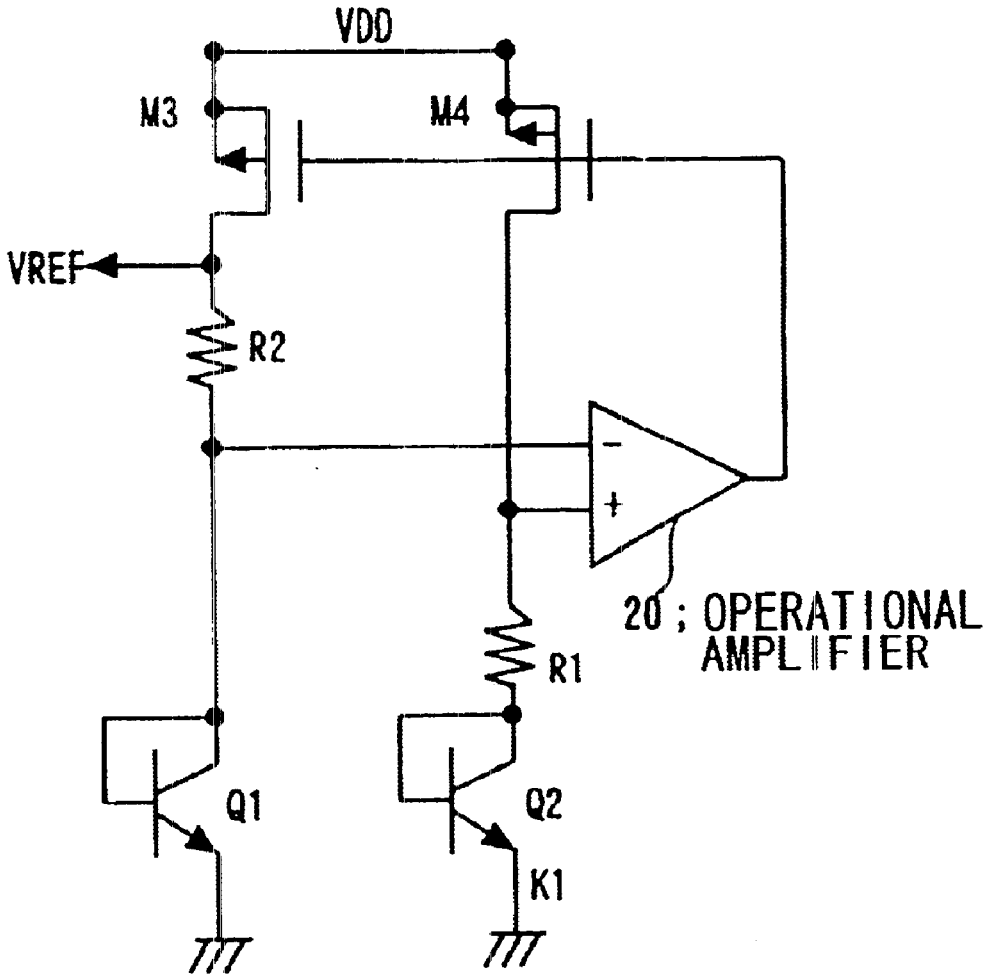
FIG . 10 PRIOR ART
FIG. 10 shows the structure of a reference voltage circuit employing a conventional operational amplifier.

The reason is that, in the reference voltage circuit of the present invention, the circuitry is constructed merely using active devices, without employing resistors as in the conventional circuitry shown in FIG. 10.

The second effect of the present invention is that the reference voltage circuit not exhibiting a temperature dependent characteristic and having an output voltage lower than 1.2 V may be implemented by the CMOS process.

The reason is that, in the reference voltage circuit of the present invention, the positive temperature characteristic of the bipolar transistor is canceled out by the negative temperature characteristic of the bipolar transistor of −1.9 mV° C. by exploiting a temperature characteristic of 5000 ppm° C. derived from the term of 1/β.

It should be noted that other objects, features and aspects of the present invention will become apparent in the entire disclosure and that modifications may be done without departing the gist and scope of the present invention as disclosed herein and claimed as appended herewith.

Also it should be noted that any combination of the disclosed and/or claimed elements, matters and/or items might fall under the modifications aforementioned.

What is claimed is:

1. A reference voltage circuit; comprising:

first and second emitter-grounded bipolar transistors, each having a base connected to a collector, with each collector being fed with a respective constant current;

first and second operational transconductance amplifiers (OTAs), each having at least a first input terminal and a second input terminal and adapted for outputting from an output terminal a current proportional to a differential voltage between voltages applied to said first and second input terminals; and a current mirror circuit having at least an input end and an output end, with the ratio of the current fed to said input end to the current output from the output end being of a predetermined value, wherein the collectors of the first and second bipolar transistors are connected respectively to the first and second input terminals of the first OTA;

said output terminal of said first OTA is connected to said input end of said current mirror circuit;

the output terminal of said second OTA is directly connected to the first input terminal of the second OTA and said collector of said second bipolar transistor is connected to the second input terminal of said second OTA; and a connection node of said first input terminal and the output terminal of said second OTA is connected to said output end of said current mirror circuit, and said output terminal of said second OTA outputs a reference voltage.

2. A CMOS reference voltage circuit for generating and outputting a reference voltage, including:

first and second diode-connected transistors, respectively grounded and driven by two constant currents with a constant current ratio; and means for amplifying a differential voltage between output voltages of said first and second diode-connected transistors by a predetermined factor and summing a resulting amplified voltage to the output voltage of said first or second diode-connected transistor, in which said means for amplifying and summing comprises:

first and second operational transconductance amplifiers (OTAs); and a current mirror circuit, wherein said first OTA has an output terminal and receives said differential voltage; and said second OTA has a first input terminal for receiving the output voltage from said first or second diode-connected transistor and has a second input terminal connected to an output terminal of said second OTA and driven with a current proportional to an output current of said first OTA, an output terminal voltage of said second OTA being said reference voltage;

said current mirror circuit having an input end connected to the output terminal of the first OTA and an output end connected to the second input terminal of the second OTA, wherein the transconductance gm1 of said first OTA is equal to the transconductance gm2 of said second OTA (gm1=gm2); and the current ratio of an input current to an output current in said current mirror circuit being set to 1:K2, where K2>1, to attain a desired amplification factor.

3. A CMOS reference voltage circuit for generating and outputting a reference voltage, including:

first and second diode connected transistors, respectively grounded and driven by two constant currents with a constant current ratio; and means for amplifying a differential voltage between output voltages of said first and second diode-connected transistors by a predetermined factor and summing a resulting amplified voltage to the output voltage of said first or second diode-connected transistor, in which said means for amplifying and summing comprises:

first and second operational transconductance amplifiers (OTAs); and a current mirror circuit, wherein said first OTA has an output terminal and receives said differential voltage; and said second OTA has a first input terminal for receiving the output voltage from said first or second diode-connected transistor and has a second input terminal connected to an output terminal of said second OTA and driven with a current proportional to an output current of said first OTA, an output terminal voltage of said second OTA being said reference voltage;

said current mirror circuit having an input end connected to the output terminal of the first OTA and an output end connected to the second input terminal of the second OTA, wherein the current ratio of an input current to an output current in said current mirror circuit is 1:1; and wherein the transconductance gm1 of said first OTA and the transconductance gm2 of said second OTA are set so that gm1=K2×gm2, where K2>1 to attain a desired amplification factor.

4. A CMOS reference voltage circuit for generating and outputting a reference voltage, including:

first and second diode-connected translator, respectively grounded and driven by two constant currents with a constant current ratio; and means for amplifying a differential voltage between output voltages of said first and second diode-connected transistors by a predetermined factor and summing a resulting amplified voltage to the output voltage of said tint or second diode-connected transistor, in which said means for amplifying and summing comprises:

first and second operational transconductance amplifiers (OTAs); and a current mirror circuit, wherein said first OTA has an output terminal and receives said differential voltage; and said second OTA has a first input terminal for receiving the output voltage from said first or second diode-connected transistor and has a second input terminal connected to an output terminal of said second OTA and driven with a current proportional to an output current of said first OTA, an output terminal voltage of said second OTA being said reference voltage;

said current mirror circuit having an input end connected to the output terminal of the first OTA and an output end connected to the second input terminal of the second OTA, wherein the current ratio of an input current to an output current in said current mirror circuit is set to 1:K2, where K2>1; and wherein the transconductance gm1 of said first OTA and the transconductance gm2 of said second OTA are set so that gm1=K3×gm2, where K3>1 to attain a desired amplification factor.

5. A CMOS reference voltage circuit for generating and outputting a reference voltage, including:

first and second diode-connected transistors, respectively grounded and driven by two constant currents with a constant current ratio; and means for amplifying a differential voltage between output voltages of said first and second diode-connected transistors by a predetermined factor and summing a resulting amplified voltage to the output voltage of said first or second diode-connected transistor, in which said means for amplifying and summing comprises (K2+1) differential pairs, K2 being an integer greater than 1, wherein the first differential pair receives said differential voltage;

one transistor of the second differential pair receives the output voltage of the first or second diode-connected transistor, whilst the other transistor of said second differential pair is diode-connected and is driven with a current proportional to an output current of one of the transistors of the first differential pair;

output voltages of diode-connected transistors of the second to number K2 differential pairs are applied to one of the differential pair transistors of the third to the number (K2+1) differential pairs, respectively, whilst the other transistors of the differential pair transistors are diode-connected and driven by currents proportional to the output current of the one transistor of the first differential pair;

the first to number (K2+1) differential pairs are driven with the (K2+1) constant currents bearing a predetermined constant current ratio relative to one another; and the differential input voltages of the second to number (K2+1) differential pairs are summed together to produce an amplified voltage with a desired amplification factor.

6. A CMOS reference voltage circuit for generating and outputting a reference voltage, including:

first and second diode-connected transistors, respectively grounded and driven by two constant currents with a constant current ratio; and a means for amplifying a differential voltage between output voltages of said first and second diode-connected transistors by a predetermined factor and summing a resulting amplified voltage to the output voltage of said first or second diode-connected transistor, in which said means for amplifying and summing comprises (K2+1) differential pairs, K2 being an integer greater than 2, wherein the first differential pair receives said differential voltage;

one transistor of the second differential pair receives the output voltage of the first or second diode-connected transistor, whilst the other transistor of said second differential pair is diode-connected;

the differential transistors of the third to number K2 differential pairs are diode-connected, a diode-connected differential transistor of a preceding differential pair and a diode-connected differential transistor of a subsequent differential pair being driven by constant currents with a predetermined constant current ratio K2;

the differential transistors of the number (K2+1) differential pairs are diode-connected, one diode-connected differential transistor being driven by a constant current along with the other diode-connected differential transistor of a preceding differential pair, the other diode-connected transistor being driven with the current proportional to the output current of said first differential pair;

the first to number (K2+1) differential pairs are driven with (K2+1) constant currents bearing a certain constant current ratio to one another; and the differential input voltages of the second to number (K2+1) differential pairs are summed together to produce a desired amplification factor.

7. A CMOS reference voltage circuit for generating and outputting a reference voltage, including:

first and second diode-connected transistors, respectively grounded and driven by two constant currents with a constant current ratio; and means for amplifying a differential voltage between output voltages of said first and second diode-connected transistors by a predetermined factor and summing a resulting amplified voltage to the output voltage of said first or second diode-connected transistor, in which said means for amplifying and summing is comprised of two differential pairs, one of the differential transistors of a second one of said differential pairs receiving the output voltage of the first or second diode-connected transistor, the other differential transistor being diode-connected and being driven with a current proportional to an output current of one of the transistors of the first differential pair;

said first differential pair and the second differential pair being driven with two constant currents having a constant current ratio to each other, and an operating input voltage range of said second differential pair being a predetermined number multiple of the operating input voltage range of said first differential pair to produce a desired amplification factor.

8. The CMOS reference voltage circuit as defined in claim 7 wherein the emitter area of said first diode-connected transistor is equal to the emitter area of said second diode-connected transistor, with the ratio of the two constant currents corresponding to said first and second diode-connected transistors not being equal to 1.

9. The CMOS reference voltage circuit as defined in claim 7 wherein the size of the first diode-connected transistor is K1 times the size of the second diode-connected transistor, with the driving current ratio of said first and second diode-connected transistors not being equal to 1, wherein K1 is an integer greater than 1.

10. The CMOS reference voltage circuit as defined in claim 7 wherein the size of the first diode-connected transistor differs from the size of the second diode-connected transistor, with the driving current ratio of said first and second diode-connected transistors being equal to 1.

11. The CMOS reference voltage circuit as defined in claim 7 further comprising a third differential pair, wherein the gate W/L ratio of each transistor of said first differential pair is K2 times the gate W/L ratio of each transistor of said second differential pair, W and L being the gate width and the gate length of the transistor, respectively;

the driving current of said second differential pair being K3 times the driving current of said third differential pair; the output current of the first differential pair being multiplied by K3 to drive the diode-connected transistor of the second differential pair to produce the desired amplification factor;

wherein K2 and K3 are integers greater than 1.

12. A CMOS reference voltage circuit for generating and outputting a reference voltage, including:

first and second diode-connected transistors, respectively grounded arid driven by two constant currents with a constant current ratio; and means for amplifying a differential voltage between output voltages of said first and second diode-connected transistors by a predetermined factor and summing a resulting amplified voltage to the output voltage of said first or second diode-connected transistor, in which said means for amplifying and summing comprises:

first and second operational transconductance amplifiers (OTAs); and a current mirror circuit connected between said first and second OTAs, wherein said first OTA receives said differential voltage; and said second OTA has a first input terminal for receiving the output voltage from said first or second diode-connected transistor and has a second input terminal directly connected to an output terminal of said second OTA and driven with a current proportional to an output current of said first OTA, an output terminal voltage of said second OTA being said reference voltage.

13. The CMOS reference voltage circuit as defined in claim 12 wherein a bipolar transistor is employed as one of said diode-connected transistors.

14. A reference voltage circuit, comprising:

an emitter-grounded bipolar transistor having a base connected to a collector, with said collector being fed with a constant current;

a cathode grounded diode fed with a second constant current;

first and second operational transconductance amplifiers (OTAs), each having at least a first input terminal and a second input terminal and adapted for outputting from an output terminal a current proportional to a differential, voltage between voltages applied to said first and second input terminals; and a current mirror circuit having at least an input end and an output end, with the ratio of the current fed to said input end to the current output from the output end being of a predetermined value, wherein either the bipolar transistor or the diode is connected to the first input terminal of the first OTA, and the other of the bipolar transistor or the diode is connected to the second input terminal of the first OTA, said output terminal of said first OTA is connected to said input end of said current mirror circuit;

the output terminal of said second OTA is directly connected to the first input terminal of said second OTA and either the bipolar transistor or the diode that is connected to the second input terminal of the first OTA is connected to the second input terminal of said second OTA; and a connection node of said first input terminal and the output terminal of said second OTA is connected to said output end of said current mirror circuit, said output terminal of said second OTA outputting a reference voltage.

15. A reference voltage circuit, comprising:

first and second emitter-grounded bipolar transistors, each having a base connected to a collector, with each collector being fed with a respective constant current;

first and second operational transconductance amplifiers (OTAs), each having at least a first input terminal and a second input terminal and adapted for outputting from an output terminal a current proportional to a differential voltage between voltages applied to said first and second input terminals; and a current mirror circuit having an input end and an output end, with the ratio of the current fed to said input end to the current output from the output end being of a predetermined value, wherein the collectors of the first and second bipolar transistors are connected respectively to the first and second input terminals of the first OTA;

said output terminal of said first OTA is connected to said input end of said current mirror circuit;

the output terminal of said second OTA and said collector of said second bipolar transistor are respectively connected to the first and second input terminals of said second OTA; and a connection node of said first input terminal and the output terminal of said second OTA is connected to said output end of said current mirror circuit, said output terminal of said second OTA outputting a reference voltage; wherein the ratio of the emitter area of the first bipolar transistor to the emitter area of the second bipolar transistor is of a value different from 1 and the respective constant currents are equal and are supplied to the respective collectors;

the ratio of the emitter area of the first bipolar transistor to the emitter area of the second bipolar transistor being of a value equal to 1 and the ratio of the respective constant currents driving the first bipolar transistor and the second bipolar transistor being of a value different from 1; or the ratio of the emitter area of the first bipolar transistor to the emitter area of the second bipolar transistor being of a value different from 1 and the ratio of the respective constant currents driving the first bipolar transistor and the second bipolar transistor being of a value different from 1; and the differential voltage ΔVBE of the base-to-emitter voltages (VBE1 and VBE2, respectively) of said first and second bipolar transistors being of a value proportional to VT (thermal voltage) having a positive temperature characteristic;

the current ratio of said current mirror circuit being K2;

the values of transconductance of said first and second OTAs being gm1 and gm2, respectively; and the reference voltage output from said output terminal of said second OTA being given by $$VBE2+\{K2\times\Delta VBE\times gm1\}/gm2.$$

16. A reference voltage circuit comprising:

first and second bipolar transistors, each having an emitter grounded and having a base connected to a collector, with each collector being fed with a respective first and second constant current;

a first differential pair comprised of a pair of MOS transistors, having sources connected in common and driven with a third constant current and having gates for receiving differentially base-to-emitter voltages of said first and second bipolar transistors;

a current mirror circuit having an input end and plural K2 number of output ends, said current mirror circuit receiving from said input end an output current of said first differential pair and outputting output currents proportional to the input current at said plural K2, where (K2≧3), number of output ends;

a second differential pair comprised of a pair of MOS transistors, having sources connected in common and driven with a fourth constant current, one of the MOS transistors having a gate fed with the base-to-emitter voltage of said second bipolar transistor and the other MOS transistor having a gate connected to a drain and connected to the first output end of said current mirror circuit; and a third to number (K2+1) differential pairs, each comprised of a pair of MOS transistors, having sources connected in common and driven with a fifth to (K2+3) constant current, one MOS transistor of said differential pair of said third to number (K2+1) differential pairs having a gate connected to a gate and a drain of a MOS transistor of a preceding second to (K2) stage differential pair and the other MOS transistor of said third to (K2+1) differential pair having a drain connected to a gate and connected to a corresponding output end of the current mirror circuit;

a reference voltage being taken out at the drain of the other MOS transistor of the number (K2+1) differential pair, wherein the other MOS transistor of said (K2+1) differential pair has the drain and the gate connected together.

17. The reference voltage circuit as defined in claim 16 wherein the ratio of the emitter area of the first bipolar transistor to the emitter area of the second bipolar transistor is of a value different from 1 and the first and second constant currents are equal and are supplied to the respective collectors;

the ratio of the emitter area of the first bipolar transistor to the emitter area of the second bipolar transistor is of a value equal to 1 and the ratio of the first and second constant currents driving the first bipolar transistor and the second bipolar transistor is of a value different from 1; or the ratio of the emitter area of the first bipolar transistor to the emitter area of the second bipolar transistor is of a value different from 1 and the ratio of the first and second constant currents driving the first bipolar transistor and the second bipolar transistor is of a value different from 1; and wherein the differential voltage ΔVBE of the base-to-emitter voltages (VBE1 and VBE2, respectively) of said first and second bipolar transistors is of a value proportional to VT (thermal voltage) having a positive temperature characteristic;

the reference voltage output from said number (K2+1) differential pair being given by $$VBE2+K2\times\Delta VBE.$$

18. A reference voltage circuit comprising:

first and second bipolar transistors, each having an emitter grounded and having a base connected to a collector, with each collector being fed with a respective constant current;

a first differential pair comprised of a pair of MOS transistors, having sources connected in common driven with a single constant current and having gates for receiving differently base-to-emitter voltages of said first and second bipolar transistors;

a current mirror circuit having an input end and an output end, said input end being fed with an output current of said first differential pair and said output end outputting an output current corresponding to a present proportion of the input current; and a second differential pair comprised of a pair of MOS transistors, having sources connected in common driven with a second single constant current, the gate of one of the MOS transistors being fed with the base-to-emitter voltage of said second bipolar transistor, the other MOS transistor having a drain and a gate connected together and connected to said output end of said current mirror circuit;

a reference voltage being taken out from the drain of the other MOS transistor of said second differential pair as an output terminal.

19. A reference voltage circuit comprising:

first and second bipolar transistors, each having an emitter grounded and having a base connected to a collector, with each collector being fed with a respective first and second constant current; and a first to (K2+1), where (K2≧3), differential pairs comprised of MOS transistors, further comprising:

said first differential pair comprised of a pair of MOS transistors, having sources connected in common driven with a third constant current and having gates for receiving differentially base-to-emitter voltages of said first and second bipolar transistors;

a first current minor circuit having an input end and an output end, said first current mirror circuit receiving from said input end an output current of said first differential pair and outputting output currents proportional to the input current at said output end;

a second current mirror circuit having an input end and plural (K2) number of output ends, said second current mirror circuit receiving from said input end a fourth constant current from a constant current source and outputting output currents proportional to the input constant current at said K2 output end;

said second differential pair comprised of a pair of MOS transistors, having sources connected in common driven with a fifth constant current, one of the MOS transistors having a gate fed with the base-to-emitter voltage of said second bipolar transistor and the other MOS transistor having a gate connected to a drain and connected to the first output end of said second current mirror circuit;

said third to number K2 differential pairs, each comprised of a pair of MOS transistors, having sources connected in common driven with a sixth to (K2+3) constant current, each MOS transistor having a drain and a gate connected together, one MOS transistor of said differential pair of said third to number (K2) differential pairs, having a drain connected to a drain of the other MOS transistor of a preceding stage differential pair, said drain of said one MOS transistor being connected to the corresponding output end of the second current mirror circuit, the other MOS transistor of said third to (K2) differential pair, baying a drain connected to a drain of one MOS transistor of a subsequent stage differential pair, said drain of the other MOS transistor being connected to a corresponding output end of said second current mirror circuit; and said (K2+1) differential pair comprising a pair of MOS transistors having sources connected in common driven with a (K2+4) constant current, each MOS transistor of said pair having a drain and a gate connected together, the drain and gate of one of the MOS transistors being connected to the drain of one MOS transistor in said K2 differential pairs, with said drain of the other MOS transistor of the (K2+1) differential pair being connected to said output end of said first current mirror circuit, a reference voltage being taken out at the drain of the other MOS transistor of the (K2+1) differential pair as an output terminal.

20. The reference voltage circuit as defined in claim 19 wherein the ratio of the emitter area of the first bipolar transistor to the emitter area of the second bipolar transistor is of a value different from 1 and the first and second constant currents are equal and are supplied to the respective collectors;

the ratio of the emitter area of the first bipolar transistor to the emitter area of the second bipolar transistor is of a value equal to 1 and the ratio of the first and second constant currents driving the first bipolar transistor and the second bipolar transistor is of a value different from 1; or the ratio of the emitter area of the first bipolar transistor to the emitter area of the second bipolar transistor is of a value different from 1 and the ratio of the first and second constant currents driving the first bipolar transistor and the second bipolar transistor is of a value different from 1; and wherein the differential voltage ΔVBE of the base-to-emitter voltages (VBE1 and VBE2, respectively) of said first and second bipolar transistors is of a value proportional to VT (thermal voltage) having a positive temperature characteristic;

the reference voltage output from said number (K2+1) differential pair being given by $$VBE2+K2\times\Delta VBE.$$

* * * * *

UNITED STATES PATENT AND TRADEMARK OFFICE

CERTIFICATE OF CORRECTION

PATENT NO. : 6,900,689 B2
DATED : May 31, 2005
INVENTOR(S) : Kimura

It is certified that error appears in the above-identified patent and that said Letters Patent is hereby corrected as shown below:

Column 24,
Line 8, "translator" should be -- transistors --.
Line 15, "tint" should be -- first --.

Column 26,
Line 41, "arid" should be -- and --.

Column 29,
Line 3, "value equal to" should be -- value different from --.

Signed and Sealed this

Twenty-first Day of March, 2006

JON W. DUDAS
*Director of the United States Patent and Trademark Office*

UNITED STATES PATENT AND TRADEMARK OFFICE

CERTIFICATE OF CORRECTION

PATENT NO. : 6,900,689 B2
APPLICATION NO. : 10/091776
DATED : May 31, 2005
INVENTOR(S) : Kimura It is certified that error appears in the above-identified patent and that said Letters Patent is hereby corrected as shown below:

On the title page Item (56) please add:

| | | | |
|---|---|---|---|
| 3,995,235 | 11-1976 | Kaplan | 327/103 |

Signed and Sealed this

Twenty-third Day of October, 2007

JON W. DUDAS
*Director of the United States Patent and Trademark Office*